US009890006B2

(12) United States Patent
Hashikawa

(10) Patent No.: US 9,890,006 B2
(45) **Date of Patent: *Feb. 13, 2018**

(54) LOOP AMOUNT ABSORPTION APPARATUS OF SLITTER LINE

(71) Applicant: JDC, inc., Sasebo-shi, Nagasaki (JP)

(72) Inventor: Yoshito Hashikawa, Sasebo (JP)

(73) Assignee: JDC, INC., Sasebo-shi, Nagasaki (JP)

( * ) Notice: Subject to any disclaimer, the term of this patent is extended or adjusted under 35 U.S.C. 154(b) by 632 days.

This patent is subject to a terminal disclaimer.

(21) Appl. No.: 14/403,205

(22) PCT Filed: Feb. 3, 2014

(86) PCT No.: PCT/JP2014/052466

§ 371 (c)(1),
(2) Date: Nov. 24, 2014

(87) PCT Pub. No.: WO2015/114837

PCT Pub. Date: Aug. 6, 2015

(65) Prior Publication Data

US 2016/0263766 A1 Sep. 15, 2016

(51) Int. Cl.
*B65H 20/12* (2006.01)
*B21C 49/00* (2006.01)
(Continued)

(52) U.S. Cl.
CPC ..... *B65H 20/12* (2013.01); *B21C 47/006* (2013.01); *B21C 49/00* (2013.01); *B26F 1/18* (2013.01);
(Continued)

(58) Field of Classification Search
CPC ..... B65H 3/10; B65H 3/12; B65H 3/0692; B65H 5/224; B65H 5/226; B65H 20/12;
(Continued)

(56) References Cited

U.S. PATENT DOCUMENTS 5,617,134 A * 4/1997 Lamothe ..... B65H 16/106 242/420.3
7,905,443 B2 * 3/2011 Papania ..... B21C 49/00 226/118.2
(Continued)

FOREIGN PATENT DOCUMENTS

EP 2 955 136 A1 12/2015
GB 1 422 456 A 1/1976
(Continued)

OTHER PUBLICATIONS

European Patent Office, "Extended European Search Report," issued in European Patent Application No. 14 789 969.4, which is a European Counterpart of U.S. Appl. No. 14/403,205, dated Oct. 26, 2017, 9 pages.

*Primary Examiner* — Michael C McCullough
(74) *Attorney, Agent, or Firm* — Amster, Rothstein & Ebenstein LLP

(57) ABSTRACT

An absorption apparatus 1 that is an example of a loop amount absorption apparatus of a slitter line to which the present invention is applied is disposed in a region of a loop pit 3 provided in the slitter line 2. The absorption apparatus 1 includes a negative pressure roll 9 that grips and conveys strips and an up-down moving device 10 that enables the negative pressure roll 9 to move up and down. By gripping and conveying the strips 14 by the negative pressure roll 9, two loops 15 of the strips are formed. The negative pressure roll 9 includes a rotating shaft 16, an inner cylinder 17, an intermediate cylinder 18, and a non-woven fabric laminated outer layer 19.

10 Claims, 22 Drawing Sheets

(51) Int. Cl.
*B65H 20/34* (2006.01)
*B21C 47/00* (2006.01)
*B26F 1/18* (2006.01)

(52) U.S. Cl.
CPC ..... *B65H 20/34* (2013.01); *B65H 2301/4148* (2013.01); *B65H 2406/3614* (2013.01); *B65H 2701/173* (2013.01)

(58) Field of Classification Search
CPC ..... B65H 29/243; B65H 29/242; B65H 2404/1363; B65H 2406/32; B65H 2406/322; B65H 2406/3122; B65H 2406/3124; B65H 2406/33; B65H 20/30; B65H 20/32; B65H 20/34; B21C 49/00
See application file for complete search history.

(56) References Cited

U.S. PATENT DOCUMENTS

| | | | | |
|---|---|---|---|---|
| 8,162,250 | B2 | 4/2012 | Hashikawa | |
| 8,201,429 | B1 * | 6/2012 | Matsunaga | B23D 15/08 72/130 |
| 8,640,862 | B2 * | 2/2014 | Perrin | D21F 7/10 198/844.1 |
| 2013/0200127 | A1 * | 8/2013 | Bentchev | B65H 20/12 226/95 |

FOREIGN PATENT DOCUMENTS

| | | | |
|---|---|---|---|
| JP | S63-106508 | U | 7/1988 |
| JP | H02-25219 | A | 1/1990 |
| JP | H03-106512 | A | 5/1991 |
| JP | H03-97442 | U | 10/1991 |
| JP | H08-26543 | A | 1/1996 |
| JP | H08-113403 | A | 5/1996 |
| JP | 2000-301239 | A | 10/2000 |
| JP | 2000-343192 | A | 12/2000 |
| JP | 2003-312909 | A | 11/2003 |
| JP | 2004-142936 | A | 5/2004 |

* cited by examiner

LOOP AMOUNT ABSORPTION APPARATUS OF SLITTER LINE

CROSS REFERENCE TO RELATED APPLICATIONS

This patent application is a U.S. national stage application under 35 U.S.C. § 371 of International Patent Application No. PCT/JP2014/052466 filed on Feb. 3, 2014, the disclosure of which is hereby incorporated by reference in its entirety.

TECHNICAL FIELD

The present invention relates to a loop amount absorption apparatus of a slitter line. More specifically, the present invention relates to a loop amount absorption apparatus of a slitter line capable of absorbing sufficiently long loops formed on a line while hardly damaging metal strips.

BACKGROUND ART

A slitter line that continuously cuts a long and wide sheet-like metal strip along the longitudinal direction into a plurality of strips while winding multiple strips simultaneously, has been used. The metal strip is cut into predetermined widths according to the use of metal coils, and ten or more strips may be made from one plate.

In a slitter line, after a metal plate is slit into multiple strips, the multiple strips are wound by a winding machine. At this time, by a tensioner provided before the winding machine, the strips are tensioned and then tightly and firmly wound into wound coils.

A sheet-like metal strip to be supplied to the slitter line is generally manufactured by rolling. Therefore, both end portions of the metal strip become thinner than the center portion, so that the thickness differs in the same sheet.

At the time of slitting, pointed burrs are generated only on the end faces of each strip, and this may cause thickness differences.

When strips are wound by the winding machine after being slit, thickness differences of the sheet or thickness differences caused by burrs become diameter differences of the wound coils. That is, a wound coil diameter of a strip with a thickness difference becomes larger than a wound coil diameter of a strip with a small thickness, and a circumferential length difference occurs between these, so that the strip to be wound into a wound coil with a larger coil diameter is wound faster.

Due to this winding speed difference, a length difference occurs between strips at a position on the downstream side of the slitter of the slitter line, and the strips form loops with different sizes. If the surface of the strip comes into contact with the floor or the like, it is damaged and its commercial value is deteriorated, so that a loop pit with a depth of several meters is provided at a position of looping on the floor surface so as to temporarily store the loops.

However, in the structure in which a loop pit is provided, the loop absorbing amount depends on the depth of the loop pit, and provision of an extremely deep loop pit is not preferable in terms of the facility cost. In addition, it is necessary that the line be stopped before the largest loop of multiple strips comes into contact with the loop pit bottom surface, and the metal coils wound until that point be separated midway and made as products, and this causes lowering of production efficiency.

In recent years, automatization has increased in the industries using strip coils, and long-length coil products have been demanded to enable long-time operation, so that a pit with a depth of 10 meters or more is inevitably dug in actuality. In particular, in electric and electronic industries, coil materials have become thinner and longer, so that the loop amounts of these tend to increase.

Under these circumstances, structures that tried to realize efficient loop absorption exist, and apparatuses described in, for example, Patent Document 1 and Patent Document 2 were proposed.

Here, in Patent Document 1, the absorption apparatus 100 shown in FIG. 22(*a*) is described. The absorption apparatus 100 is structured to supply a loop 101*a*, a loop 101*b*, a loop 101*c*, and a loop 101*d* of strips from the loop pit 102 side to the guide roller 104 provided on the holding arm 103. The strips flow from the guide roller 104 to the rolls 105 and the subsequent winding machine 112 side.

The absorption apparatus 100 is structured so that the guide roller 104 is extended to the slitter 106 side via a cylinder device. In Patent Document 1, the absorption apparatus 107 shown in FIG. 22(*b*) is also described.

The absorption apparatus 107 is structured so that a carriage 109 to which the guide roller 108 is attached moves on a rail 110 extended in the horizontal direction. Strips flow to the rolls 111 and the subsequent winding machine side via the guide roller 108.

In Patent Document 2, a structure in which an absorption tower having a roll movable up and down is installed by the side of the loop pit, and when a loop sags, the loop is lifted up by the roll of the absorption tower.

As another structure, as shown in FIG. 23, there is also a structure in which a pinch-roll type conveyance roll 114 that pinches strips by two rolls 113 disposed on the upper and lower sides and pushes the strips out to the winding machine side is installed in the looping region so that two-divided loops 116 are formed in the loop pit 115.

PRIOR ART DOCUMENTS

Patent Literature

Patent Document 1: Japanese Published Unexamined Patent Application No. 2000-301239

Patent Document 2: Japanese Published Unexamined Utility Model Application No. Hei-03-97442

SUMMARY OF THE INVENTION

Problem to be Solved by the Invention

However, the structures described in Patent Document 1 and Patent Document 2 cannot sufficiently absorb the lengths of the loops.

For example, describing the absorption apparatus shown in FIG. 22(*b*), sufficient absorption of the loop amount means an increase in distance designated by the reference symbol H which is the difference between the lowermost loop 101*d*, that is, the largest loop, and the uppermost loop 101*a*.

In the absorption apparatus 107, all strips forming the loop 101*a*, the loop 101*b*, the loop 101*c*, and the loop 101*d* are subjected to the absorption apparatus 107. That is, even by lengthening all strips in the directions designated by the reference symbols L and h in FIG. 22(*b*), the distance designated by the reference symbol H does not become longer, so that this structure cannot sufficiently absorb the lengths of the loops.

To increase the distance designated by the reference symbol H, there is a possible method by which only the lowermost loop 101*d* is subjected to the absorption apparatus.

However, before starting operation of the line, it cannot be always estimated which strip forms a larger loop, so that each time the loop 101*d* is formed, the line must be stopped to subject the loop to the absorption apparatus. This operation is difficult, and this seems an unrealistic method in terms of operation efficiency.

Further, this method is inconvenient since the absorption apparatus needs an installation space in a considerable range beyond the region of the loop pit, and maintenance of the apparatus is troublesome.

Even with the absorption tower described in Patent Document 2, only one loop can be formed in the loop pit although the absorption tower makes slightly larger the size of the loop to be absorbed, and therefore, this structure cannot sufficiently absorb the length of the loop.

On the other hand, in the structure using the pinch-roll type conveyance roll 114, the strip in the middle of the loop is pinched by the pinch roll 113 and pushed out, so that two loops 116 can be formed in the loop pit. However, the necessity of pinching the strip becomes an issue.

That is, on the side closer to the winding machine than the pinch roll 113 on the line, the second loop is formed, so that the strip is fed to the downstream side of the line while being gripped by a pressure, so that this pressure damages the surface of the strip.

The damage on the strip surface becomes a fatal defect for a metal strip to be used for the purpose requiring high-quality surface finishing. In addition, when the strip is formed of a thin material such as metal foil, the shape itself may be deformed.

The present invention was made in view of the above-described circumstances, and an object thereof is to provide a loop amount absorption apparatus of a slitter line capable of absorbing sufficiently long loops generated on the line while hardly damaging metal strips.

Means for Solving the Problems

In order to achieve the above-described object, a loop amount absorption apparatus of a slitter line according to the present invention includes a rotating body that is constituted to be rotatable and movable up and down, and disposed between a slitter and a tensioner of the slitter line, a conduction hole which is provided inside the rotating body and in which a negative pressure is formed by a predetermined suction device, a conduction groove formed on the surface of the rotating body and connected to the conduction hole, and an outer layer portion low in breathability provided on the outside of the conduction groove.

Here, by the conduction hole which is provided inside the rotating body and in which a negative pressure is formed by a predetermined suction device, the pressure inside the rotating body can be made negative. As the predetermined suction device, for example, a vacuum pump or an ejector, etc., can be used, and by connecting this to the conduction hole, the air inside the rotating body is discharged and a negative pressure can be generated in the loop amount absorption apparatus.

The conduction groove is formed on the surface of the rotating body and connected to the conduction hole, so that the conduction groove and the conduction hole conduct to each other, and the region of the negative pressure generated in the conduction hole can be broadened to the surface of the rotating body. By the conduction groove, the region of the negative pressure can be broadened. That is, inside the apparatus, the negative pressure can be applied up to the end portion of the apparatus distant from the conduction hole.

By the conduction hole in which a negative pressure is formed by a predetermined suction device and the conduction groove formed on the surface of the rotating body and connected to the conduction hole, the negative pressure is applied to the strips in contact with the surface of the rotating body, and the strips can be adsorbed. Without damaging the surfaces of the strips, the strips can be gripped by the rotating body. The adsorption by a negative pressure mentioned here is caused by a pressing force applied by the atmosphere to the surfaces of the strips in contact with the rotating body.

By the conduction hole in which a negative pressure is formed by a predetermined suction device, the conduction groove formed on the surface of the rotating body and connected to the conduction hole, and the outer layer portion low in breathability provided on the outside of the conduction groove, the amount of air to flow to the inside of the apparatus from the outside can be reduced while the region of the negative pressure inside the apparatus is broadened. That is, the degree of negative pressure inside the apparatus is increased, and the adsorption force to be applied to the strips in contact with the apparatus can be increased.

By the rotating body constituted to be rotatable, the gripped strips can be conveyed to the downstream side of the slitter line while being gripped. That is, by disposing the rotating body at a position at which the strips loop, the rotating body can grip the strips and cause the strips to form two loops before and after the rotating body on the line. As a result, a larger difference between a large loop and a small loop can be allowed.

Further, by the rotating body that is constituted to be rotatable and disposed between the slitter and the tensioner of the slitter line, two loops can be formed in the region between the slitter and the tensioner. That is, two loops are formed in the region in which a loop pit is usually provided.

Due to the rotating body constituted to be movable up and down, the height of the rotating body can be changed with respect to the strips to be threaded in the slitter line. That is, by lifting up the gripped strips to a height equal to or higher than the height of the strips being threaded, the loop amounts can be increased.

When the air permeability of the outer layer portion is 0.8 $cm^3/cm^2 \cdot s$ or less measured by a Frazier type air permeability tester, the outer layer portion hardly sucks in extra outside air. As a result, the degree of negative pressure inside the apparatus becomes sufficiently high, and a sufficient gripping force can be applied to the strips.

When the rotating body is constituted to be movable up from the vicinity of a loop pit that is a recess formed in the region between the slitter and the tensioner, the installation space and installation labor of the apparatus can be reduced. In addition, efficiency of maintenance of the apparatus can be improved. That is, a structural body that enables the rotating body to move up is provided outside the loop pit, and the apparatus can be easily provided in the slitter line. The vicinity of the loop pit mentioned here means the region outside the loop pit, for example, a position which is flush with the floor surface on which the slitter and the tensioner are disposed, and on which the strips can be hung to form loops of the strips in the loop pit.

When the rotating body is constituted to be movable up from the vicinity of the bottom portion of the loop pit that is a recess formed in the region between the slitter and the tensioner, the operation of hanging the strips on the rotating body can be easily performed. For example, when a mechanism that automatically performs the operation of hanging the strips on the rotating body is adopted, the rotating body can be moved up from the position below the loops of the strips, so that the strips can be smoothly hung.

When the apparatus includes a sensor unit that is disposed near the bottom portion of the loop pit and can detect strips, a large loop can be detected before it comes into contact with the bottom of the loop pit.

When the rotating body is constituted so that the rotation speed thereof is adjustable, the gripping conveyance speed of strips by the apparatus can be synchronized with the threading speed of the strips in the slitter line. That is, according to the threading speed of strips, loops can be formed.

When a separator that is disposed on the slitter side of the rotating body and has a plurality of partition disks approximately parallel to the advancing direction of strips to be threaded is provided, the strips after being slit can be brought into stable contact with the rotating body.

When a substantially cylindrical intermediate cylinder portion that is provided between the conduction groove and the outer layer portion and has a plurality of ventilation holes formed therein is provided, the negative pressure generated in the conduction groove can be applied to the outer layer portion through the plurality of ventilation holes. Accordingly, a negative pressure can be efficiently generated in the outer layer portion.

When the rotating body is formed into a substantially cylindrical shape, a plurality of the conduction holes are formed in the circumferential direction of the rotating body, and a plurality of the conduction grooves are formed in the longitudinal direction of the rotating body, a negative pressure can be continuously applied to the strips in contact with the apparatus being rotated. That is, an adsorption force is continuously generated on the surface of the rotating body due to the negative pressure.

When the rotating body is formed into a substantially cylindrical shape, a plurality of conduction holes are formed in the circumferential direction of the rotating body, the conduction holes adjacent to each other are at a fixed interval, a plurality of conduction grooves are formed in the longitudinal direction of the rotating body, and the conduction grooves adjacent to each other are at a fixed interval, unevenness of the adsorption force on the surface of the apparatus can be suppressed. That is, conduction holes and conduction grooves adjacent to each other do not communicate with each other, so that a state in which only air at the position near the suction device is suctioned can be prevented, and a negative pressure can be uniformly generated up to the end portions of the rotating body.

When the outer layer portion is made of non-woven fabric low in breathability, the degree of breathability of the outer layer portion can be easily adjusted. That is, for example, when it is desired to increase the degree of negative pressure inside the apparatus in such a case where strips are comparatively thick and need a strong gripping force, this can be realized by using non-woven fabric with extremely low breathability or forming a multi-layered structure by laminating a plurality of non-woven fabrics. In addition, when the surface of the non-woven fabric is contaminated or clogged, the outer layer portion can be easily replaced, and maintenance of the apparatus is easily performed.

When the outer layer portion is composed of a non-woven fabric low in breathability provided on the outside of the conduction groove and an outer layer member that is laminated on the outside of the non-woven fabric, has a frictional coefficient higher than that of the non-woven fabric, and has many minute through-holes formed therein, while the negative pressure inside the apparatus is increased, the frictional force between the outer layer portion and the strips increases, so that the gripping force for gripping the strips can be increased.

Effect of the Invention

The loop amount absorption apparatus of a slitter line according to the present invention hardly damages the metal strips, and can absorb sufficiently long loops formed on the line.

BEST MODE FOR CARRYING OUT THE INVENTION

Hereinafter, an embodiment of the present invention is described with reference to the drawings for understanding of the present invention.

Figure 1:
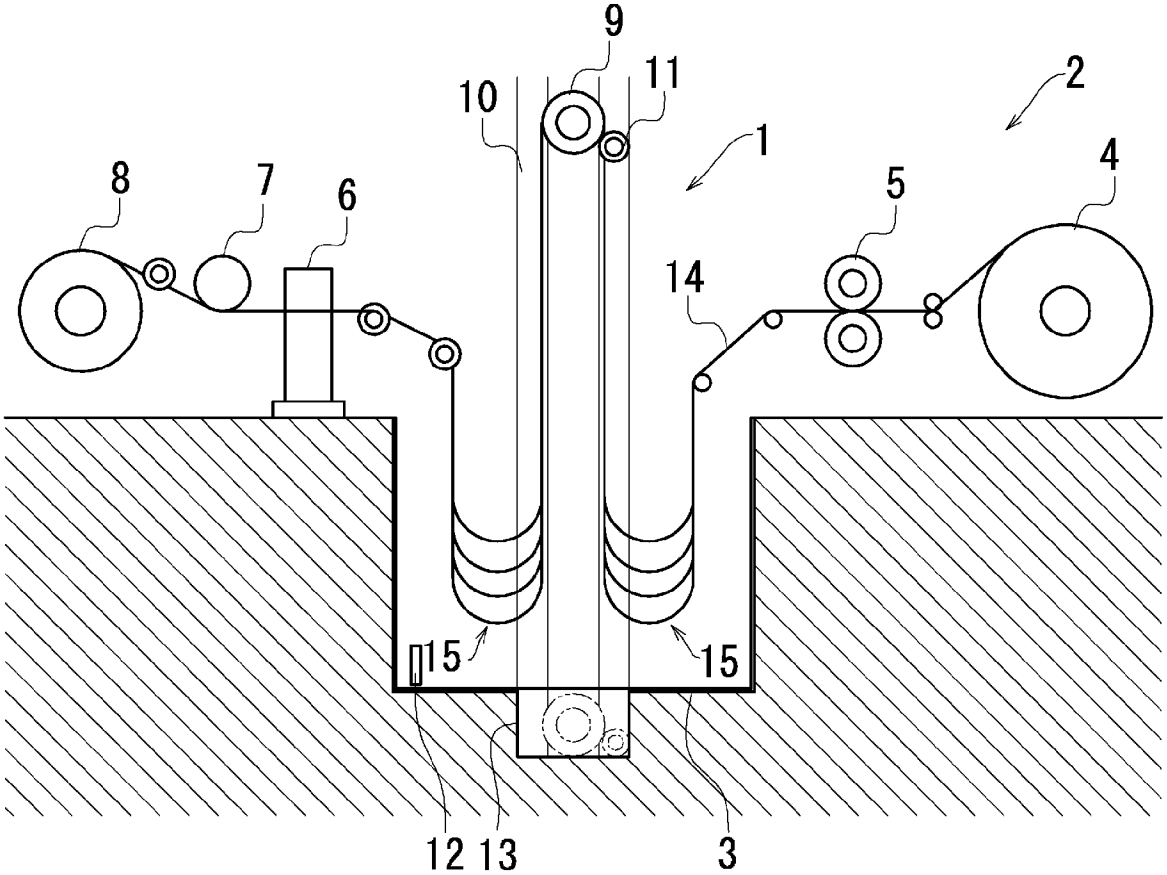
FIG. 1 is a schematic view showing an example and a disposing position of a loop amount absorption apparatus of a slitter line to which the present invention is applied.
Figure 2:
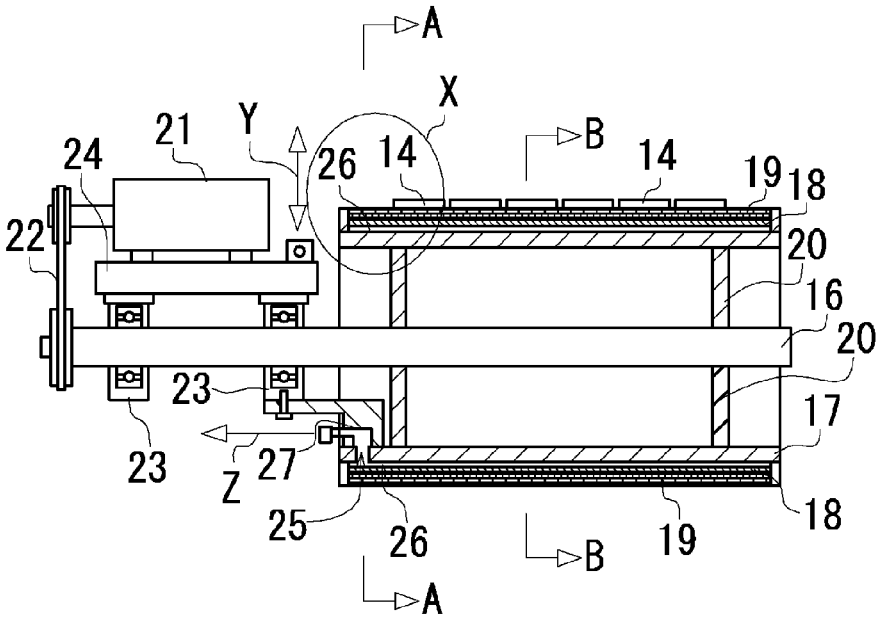
FIG. 2 is a schematic view showing a structure of a negative pressure roll.

FIG. 1 is a schematic view showing an example and a disposing position of a loop amount absorption apparatus of a slitter line to which the present invention is applied. FIG. 2 is a schematic view showing a structure of a negative pressure roll.

Here, as shown in FIG. 1, the absorption apparatus 1 as an example of the loop amount absorption apparatus of a slitter line to which the present invention is applied is disposed inside the region of the loop pit 3 provided in the slitter line 2.

In the slitter line 2, an uncoiler 4 that uncoils a metal strip from a rolled metal strip coil, and a slitter 5 that slits the metal strip into strips 14, are disposed. On the downstream side of the loop pit 3, a tensioner 6 that applies a winding tensile force to the strips 14, a deflector roll 7 that changes the threading angle of the strips 14, and a winding machine 8 that winds the strips 14, are disposed.

The absorption apparatus 1 includes a negative pressure roll 9 that grips and conveys the strips 14, and an up-down moving device 10 that enables the negative pressure roll 9 to move up and down. By gripping and conveying the strips 14 by the negative pressure roll 9, two loops 15 of the strips are formed.

To the slitter 5 side of the negative pressure roll 9, a separator 11 is attached. The separator 11 is a structure for stabilizing the strips 14 before the multiple strips 14 are brought into contact with the negative pressure roll 9 while preventing the strips 14 from overlapping each other.

On the bottom portion side surface of the loop pit 3, a sensor 12 that can detect strips 14 and interlock with the up-down moving device 10 is provided. At the center portion of the loop pit 3, a negative pressure roll standby position 13 capable of accommodating the negative pressure roll 9 inside is formed.

Here, the sensor 12 does not necessarily have to be provided on the bottom portion side surface of the loop pit 3. For example, it is also possible that before the loops 15 of the strips 14 come into contact with the floor surface of the loop pit 3, the loops are visually confirmed, and the slitter line 2 is stopped and then the strips 14 are set on the negative pressure roll 9 and the separator 11.

In addition, the negative pressure roll standby position 13 does not necessarily have to be formed at the center portion of the loop pit 3. For example, a structure that causes the negative pressure roll 9 to stand by at a position on the bottom portion of the loop pit 3 or a position near the floor surface on which the slitter 5, etc., are installed, can also be adopted.

As shown in FIG. 2, the negative pressure roll 9 includes a rotating shaft 16, an inner cylinder 17, an intermediate cylinder 18, and a non-woven fabric laminated outer layer 19. Hereinafter, the internal structure of the negative pressure roll 9 is described in detail.

The rotating shaft 16 is a member that becomes the center of rotation of the negative pressure roll 9, and is connected to the inner cylinder 17 by a reinforcement disk 20. The inner cylinder 17 has a cylindrical shape, and rotates together with the rotating shaft 16. The rotating shaft 16 and the inner cylinder 17 are equivalent to the rotating body.

The intermediate cylinder 18 is a cylindrical tubular material formed on the outside of the inner cylinder 17, and rotates in conjunction with the rotating shaft 16 and the inner cylinder 17. The non-woven fabric laminated outer layer 19 is formed on the outside of the intermediate cylinder 18, and is a portion at which the negative pressure roll 9 and the strips 14 come into contact with each other. The non-woven fabric laminated outer layer 19 also rotates in conjunction with the rotating shaft 16, the inner cylinder 17, and the intermediate cylinder 18.

The negative pressure roll 9 has a drive motor 21. The drive motor 21 is connected to the rotating shaft 16 via a chain 22, and rotates the rotating shaft 16.

The negative pressure roll 9 is joined to an up-down guide member 24 via the rotating shaft 16 and a bearing 23 supporting the rotating shaft 16. The up-down guide member 24 constitutes the up-down moving device 10 that enables the negative pressure roll 9 to move up and down in the vertical direction shown by the arrow Y.

Here, the negative pressure roll 9 does not necessarily have to be composed of the rotating shaft 16, the inner cylinder 17, the intermediate cylinder 18, and the non-woven fabric laminated outer layer 19. However, manufacturing and maintenance of the negative pressure roll 6 become easy if it is divided into the respective members, and therefore, the negative pressure roll 9 is preferably composed of the rotating shaft 16, the inner cylinder 17, the intermediate cylinder 18, and the non-woven fabric laminated outer layer 19.

The rotating body does not necessarily have to be composed of the rotating shaft 16, the inner cylinder 17, and the reinforcement disk 20. However, the rotating body is preferably composed of the rotating shaft 16, the inner cylinder 17, and the reinforcement disk 20 since they provides strength to the rotating body. When the rotating shaft 16, the inner cylinder 17, and the reinforcement disk 20 are formed integrally of the same metal, the strength can be further increased, and this is more preferable. In a comparatively small apparatus, the inner cylinder 17 may not be cylindrical, and it is possible that the negative pressure roll 9 includes the inner cylinder that is obtained by machining a solid material to become integral with the rotating shaft 16.

The materials of the rotating shaft 16 and the inner cylinder 17 are not particularly restricted. For example, by using a plastic material, the manufacturing cost can be reduced.

The structure among the rotating shaft 16, the inner cylinder 17, the intermediate cylinder 18, and the non-woven fabric laminated outer layer 19 is not restricted, and is only required to enable these members to rotate integrally in the same direction. That is, these members may be joined by fixtures, or a structure that rotates them integrally by frictional engagement caused by frictional forces applied between the members may be adopted.

The kind of the bearing 23 is not particularly restricted. For example, the bearing 23 may be a ball bearing. However, for smooth rotation of the shaft and improvement in durability of the apparatus, an anti-friction bearing or a sliding bearing is preferably adopted.

The negative pressure roll 9 does not necessarily have to have the drive motor 21, and is only required to become rotatable by obtaining motive power. The structure and kind of the drive motor 21 are not particularly restricted.

The drive motor 21 does not necessarily have to be connected to the rotating shaft 16 via the chain 22, and is only required to have a structure in which motive power generated by the drive motor 21 is transmitted to the rotating shaft 16. For example, a structure in which the drive motor is connected by a V-belt instead of the chain and a structure in which the drive motor and the rotating shaft are directly connected, etc., can also be adopted.

As shown in FIG. 2, on one end side of the inner cylinder 17, negative pressure conduction holes 25 pierced through the inner cylinder 17 are formed. The negative pressure conduction hole 25 serves as a flow passage of air when the air inside the negative pressure roll 9 is discharged by a vacuum pump (not illustrated). A plurality of negative pressure conduction holes are formed at fixed intervals in the circumferential direction of the inner cylinder 17. The arrow Z shows a direction of suctioning the negative pressure roll 9 by the vacuum pump.

Here, in the present invention, the suctioning amount of the outside air is limited by using the material low in breathability, so that it is not necessary to use an exhaust blower with a high capacity as a suction device. The back surfaces of the strips 14 in contact with the negative pressure roll 9 are maintained in a negative pressure state, and by pressing caused by the atmosphere, an adsorption force is generated, so that a vacuum pump or ejector, etc., that generates a high degree of vacuum although its suctioning amount is small can be used.

On the surface of the inner cylinder 17, negative pressure conduction grooves 26 connected to the negative pressure conduction holes 25 are provided. The negative pressure conduction grooves 26 are formed along the longitudinal direction of the negative pressure roll 9 to generate a negative pressure up to the end portions of the negative pressure roll 9.

On the rotating shaft 16 side of the negative pressure roll 9, a negative pressure conduction portion 27 communicating with the negative pressure conduction holes 25 is provided. The negative pressure conduction portion 27 is connected to the vacuum pump, and serves as a suction port for making the pressure inside the negative pressure roll 9 negative.

The negative pressure conduction portion 27 is connected and fixed to the bearing 23, and increases the airtightness inside the negative pressure roll 9 while being in contact with the negative pressure conduction holes 25 rotating together with the rotating shaft 16.

Here, the negative pressure conduction holes 25 are only required to forma negative pressure inside the negative pressure roll 9, and the number of the negative pressure conduction holes and the positions at which they are formed are not particularly restricted. However, for continuously providing a negative pressure to the negative pressure roll 9 being rotated, the negative pressure conduction holes 25 are preferably arranged at even intervals in the circumferential direction of the inner cylinder 17.

The negative pressure conduction holes 25 do not necessarily have to be formed on only one end side of the inner cylinder 17. For example, when a long-length negative pressure roll is used, it is also possible that the negative pressure conduction holes 25 and a flow passage of the vacuum pump are provided on both sides of the inner cylinder 17 so that the air inside the negative pressure roll 9 is discharged from both end portions.

The negative pressure conduction portion 27 does not necessarily have to be provided, and it is only required that a structure that can form a negative pressure inside the negative pressure roll 9 be provided, and other known technologies may be used. However, for increasing the airtightness inside the negative pressure roll 9, it is preferable to provide the negative pressure conduction portion 27.

The negative pressure conduction portion 27 does not necessarily have to be connected to the bearing 23. However, it is preferable to connect the negative pressure conduction portion 27 and the bearing 23 since the negative pressure conduction portion 27 is accordingly fixed and the airtightness between the negative pressure conduction portion and the negative pressure conduction holes 25 is easily increased.

The internal structure of the negative pressure roll is described in greater detail.

Figure 3:
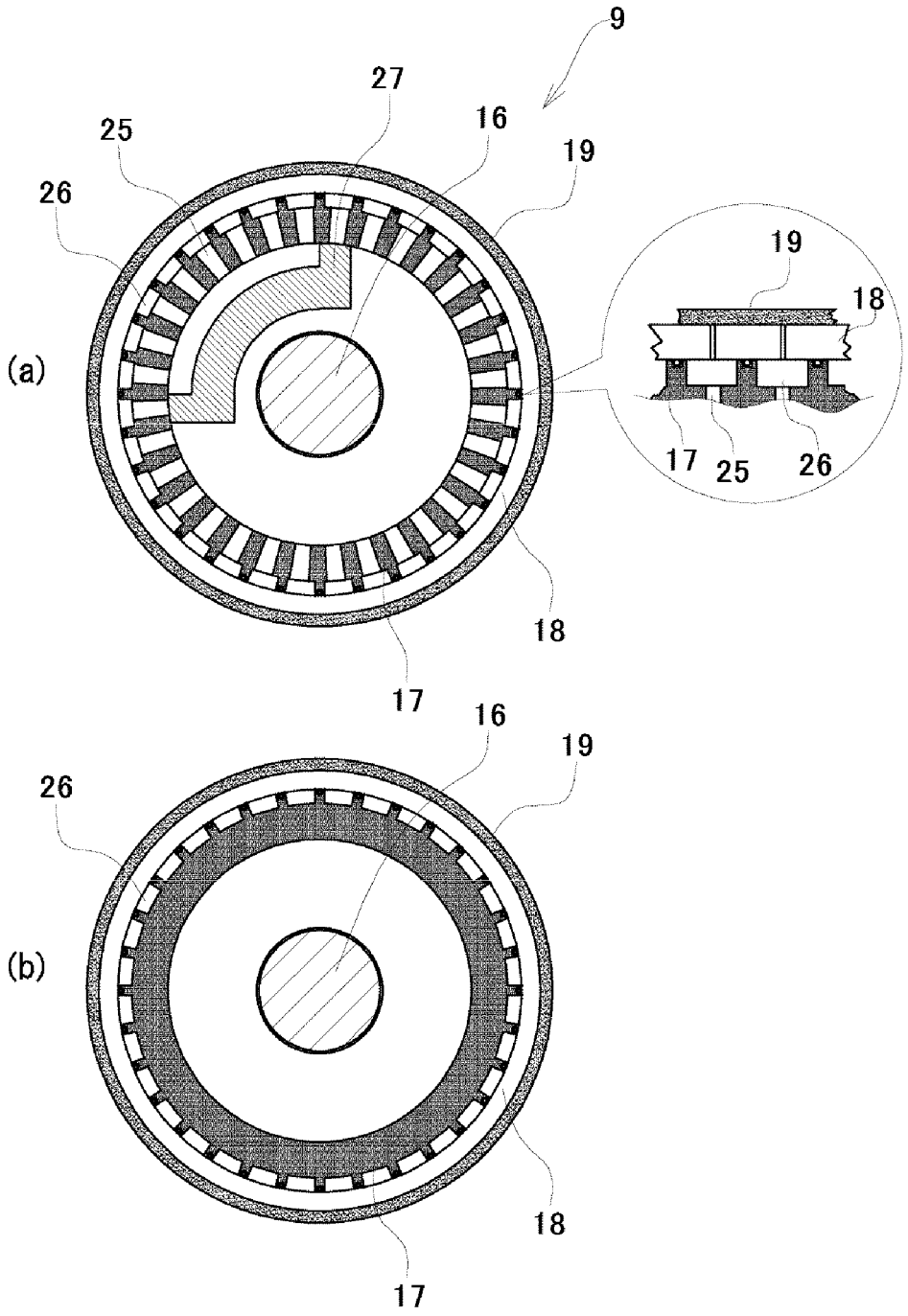
FIG. 3(*a*) is a cross sectional view taken along the line A-A, and FIG. 3(*b*) is a cross sectional view taken along the line B-B, in the schematic view shown in FIG. 2.
Figure 4:
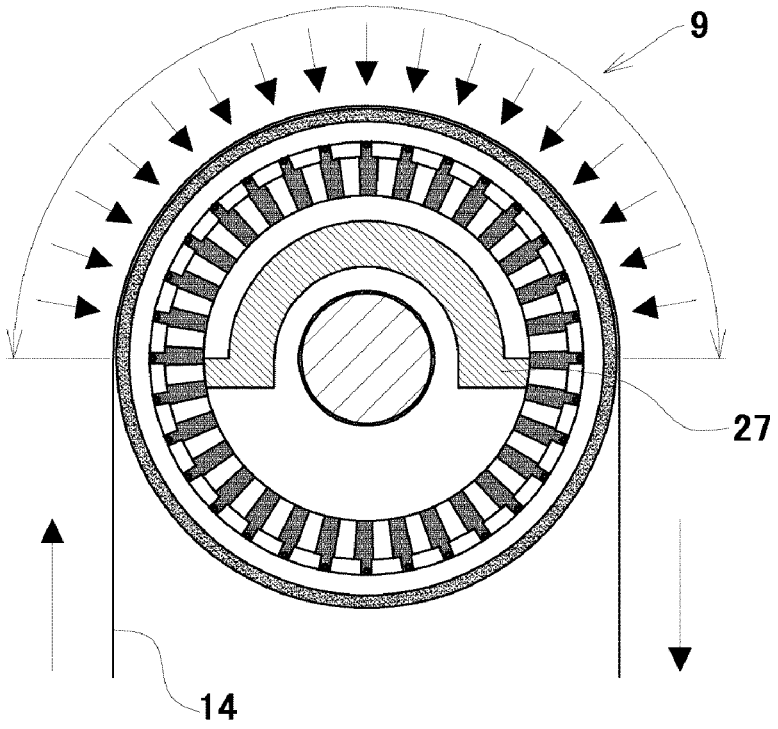
FIG. 4 is a schematic cross sectional view of a negative pressure roll having a negative pressure region of 180 degrees on the roll circumference.
Figure 5:
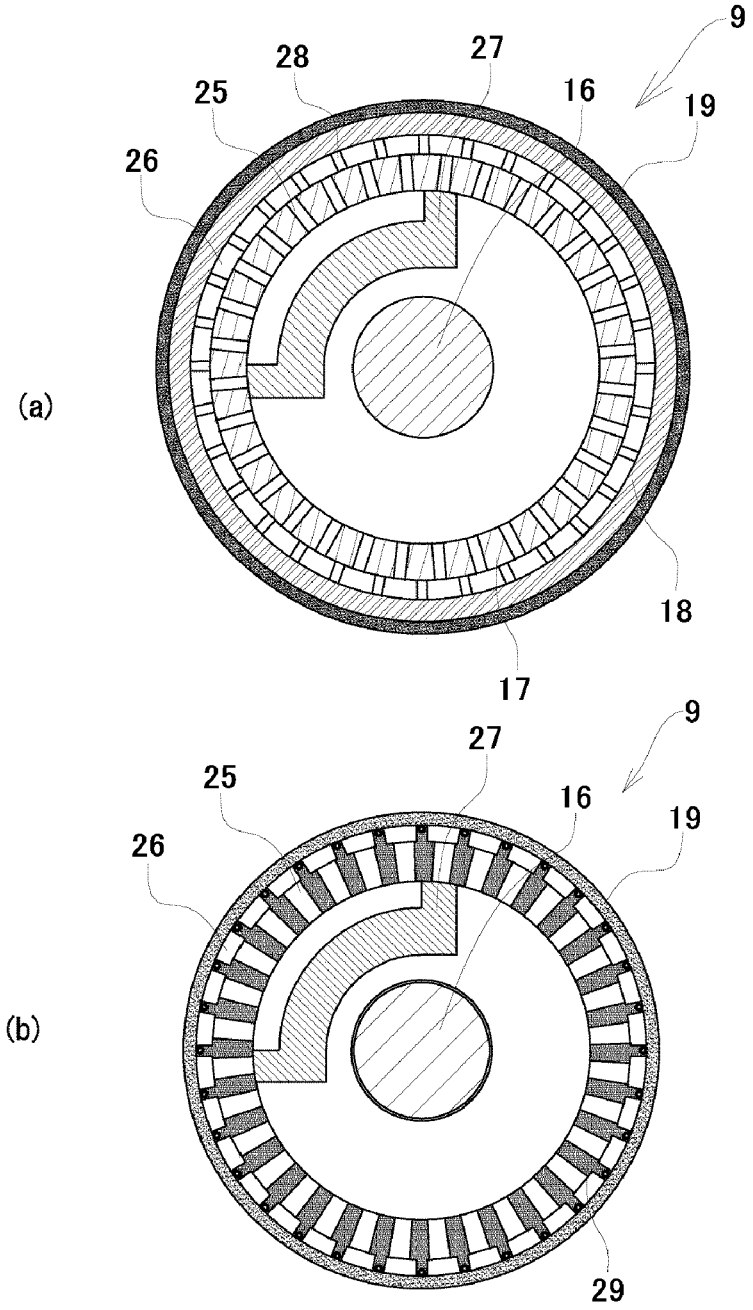
FIG. 5(*a*) is a schematic cross sectional view at a position corresponding to a negative pressure conduction portion of another example of the negative pressure roll, and FIG. 5(*b*) is a schematic cross sectional view at a position corresponding to a negative pressure conduction portion of still another example of the negative pressure roll.
Figure 6:
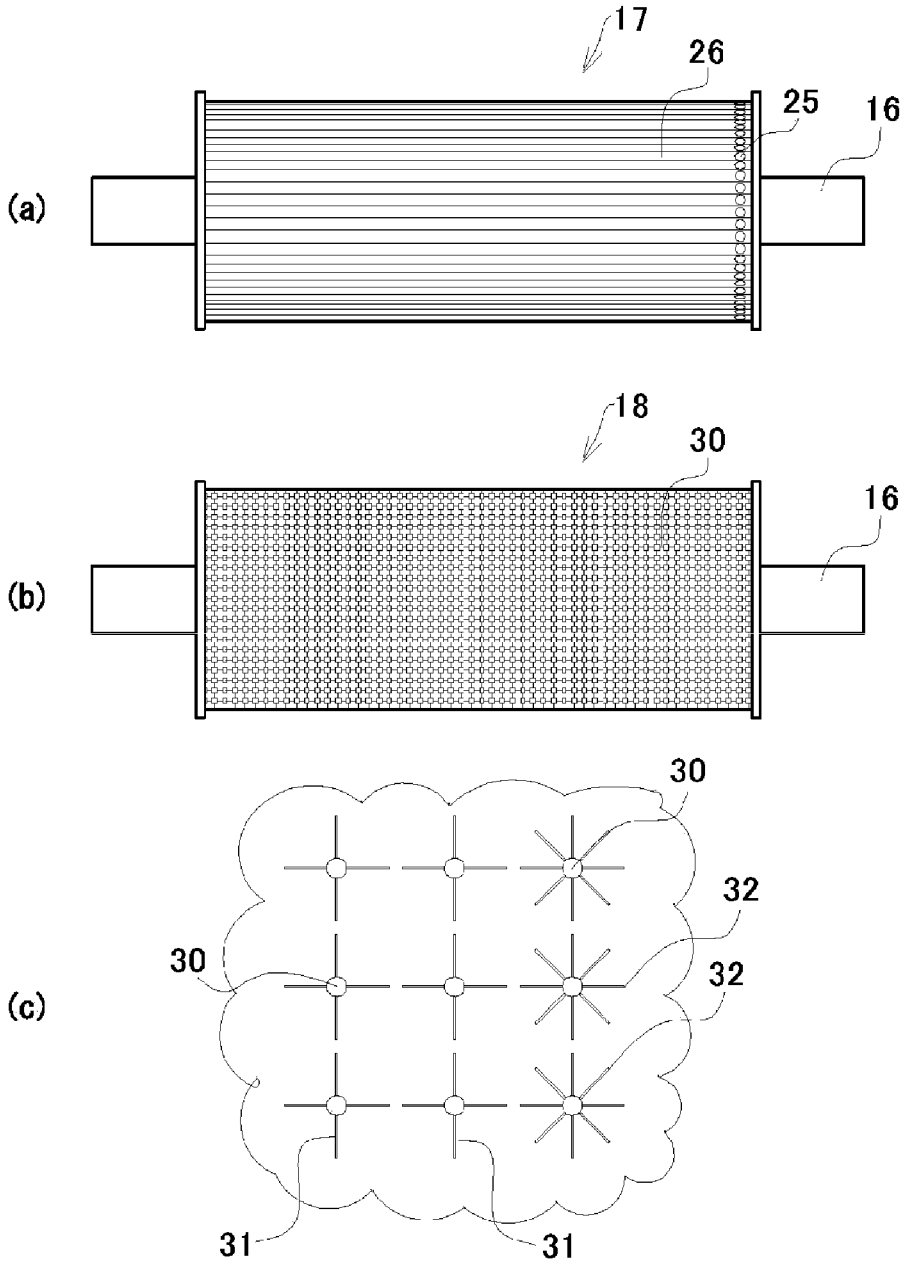
FIG. 6(*a*) is a schematic view showing an inner cylinder, FIG. 6(*b*) is a schematic view showing an intermediate cylinder, and FIG. 6(*c*) is a schematic view showing ventilation hole groove portions provided around ventilation holes.
Figure 7:
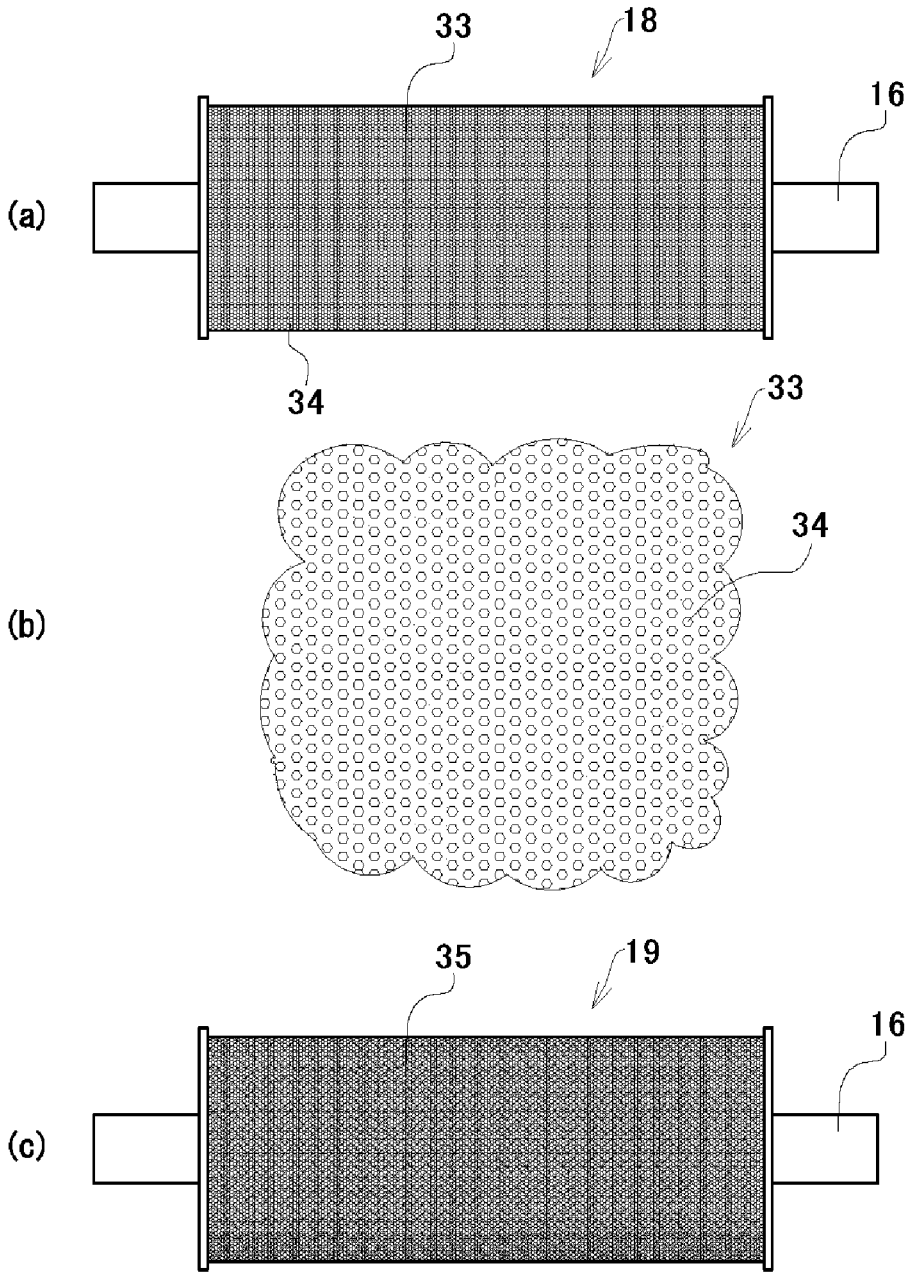
FIG. 7(*a*) is a schematic view showing an intermediate cylinder using perforated metal, FIG. 7(*b*) is a schematic view showing many small-diameter holes of perforated metal, and FIG. 7(*c*) is a schematic view showing a multi-layered non-woven fabric laminated outer cylinder.
Figure 8:
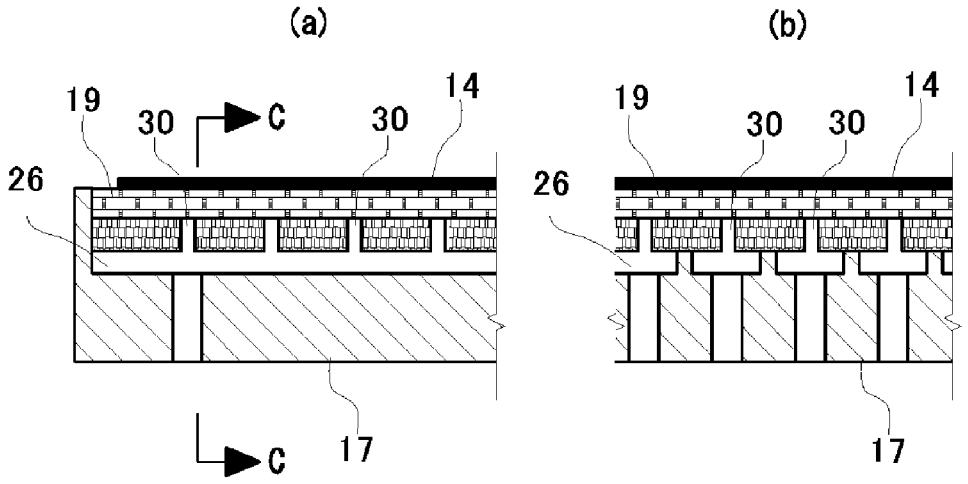
FIG. 8(*a*) is a cross sectional view showing details of the X portion in FIG. 2, and FIG. 8(*b*) is a cross sectional view taken along the line C-C in the cross sectional view of FIG. 8(*a*).
Figure 9:
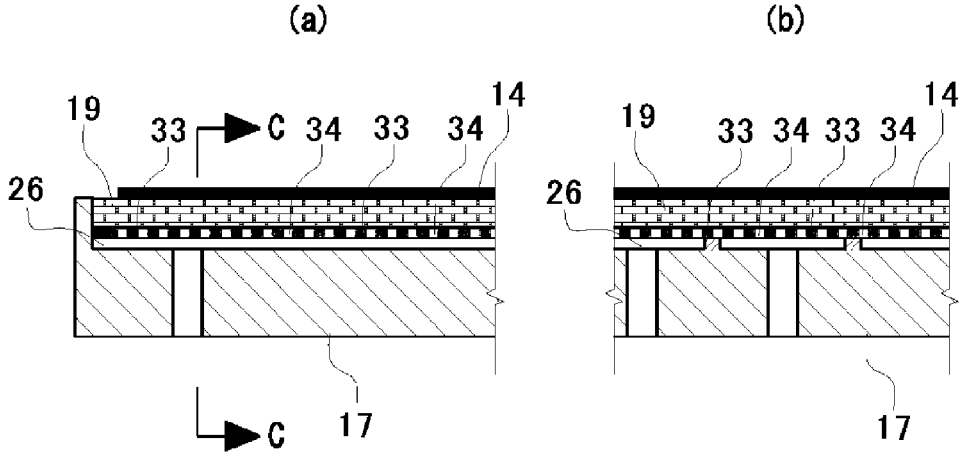
FIG. 9(*a*) is a cross sectional view corresponding to FIG. 8(*a*), and FIG. 9(*b*) is a cross sectional view corresponding to FIG. 8(*b*), showing another example of the negative pressure roll.

FIG. 3(*a*) is a cross sectional view taken along the line A-A, and FIG. 3(*b*) is a cross sectional view taken along the line B-B, in the schematic view shown in FIG. 2. FIG. 4 is a schematic cross sectional view of a negative pressure roll having a negative pressure region of 180 degrees on the roll circumference. FIG. 5(*a*) is a schematic cross sectional view at a position corresponding to a negative pressure conduction portion of another example of the negative pressure roll, and FIG. 5(*b*) is a schematic cross sectional view at a position corresponding to a negative pressure conduction portion of still another example of the negative pressure roll. FIG. 6(*a*) is a schematic view showing an inner cylinder, FIG. 6(*b*) is a schematic view showing an intermediate cylinder, and FIG. 6(*c*) is a schematic view showing ventilation hole groove portions provided around ventilation holes. FIG. 7(*a*) is a schematic view showing an intermediate cylinder using perforated metal, FIG. 7(*b*) is a schematic view showing many small-diameter holes of perforated metal, and FIG. 7(*c*) is a schematic view showing a multi-layered non-woven fabric laminated outer cylinder. FIG. 8(*a*) is a cross sectional view showing details of the X portion in FIG. 2, and FIG. 8(*b*) is a cross sectional view taken along the line C-C in the cross sectional view of FIG. 8(*a*). FIG. 9(*a*) is a cross sectional view corresponding to FIG. 8(*a*), and FIG. 9(*b*) is a cross sectional view corresponding to FIG. 8(*b*), showing another example of the negative pressure roll.

One end side of the negative pressure roll 9 has the section as shown in FIG. 3(*a*). On one end side of the negative pressure roll 9, the negative pressure conduction portion 27 and the negative pressure conduction holes 25 are provided. The negative pressure conduction portion 27 is formed in a region accounting for approximately 90 degrees on the circumference of the negative pressure roll 9. The negative pressure roll 9 comes into contact with strips 14 at a position corresponding to this negative pressure conduction portion 27. The right-side drawing in FIG. 3(*a*) shows the surface region of the negative pressure roll 9 in an enlarged manner.

As shown in FIG. 3(*b*), in the region distant from the one end side of the negative pressure roll 9, the negative pressure roll 9 is composed of the inner cylinder 17, the negative pressure conduction grooves 26, the intermediate cylinder 18, and the non-woven fabric laminated outer layer 19.

Here, the negative pressure conduction portion 27 does not necessarily have to be formed in the region occupying approximately 90 degrees on the circumference of the negative pressure roll 9, and is only required to become capable of gripping and conveying strips 14.

For example, as shown in FIG. 4, the negative pressure conduction portion 27 may be formed in the region of approximately 180 degrees on the circumference of the negative pressure roll 9. In this case, the negative pressure roll comes into contact with strips 14 that moved up from the lower side in the region of substantially 180 degrees on the negative pressure roll 9, so that a larger negative pressure can be applied to the strips. That is, a stronger gripping force can be applied. By preparing the negative pressure conduction portion 27 as a replacement part having an arbitrary angle, the negative pressure region in the circumferential direction can be arbitrarily adjusted.

FIG. 5(*a*) is a view showing a structure of another example of the negative pressure roll. Here, the difference from the apparatus shown in FIG. 2 and FIG. 3 is in that partition projections 28 are provided on the surface of the inner cylinder 17 and the negative pressure conduction grooves 26 are formed between the partition projections 28. Thus, the negative pressure conduction grooves 26 may be formed as a layer separate from the inner cylinder 17.

By using an elastic material such as soft rubber with appropriate hardness for the partition projections 28, the partition projections come into close contact with the inner cylinder 17 and the intermediate cylinder 18, so that it is also possible to improve the airtightness of the negative pressure conduction grooves 26.

FIG. 5(*b*) is a view showing a structure of still another example of the negative pressure roll. The apparatus shown in FIG. 5(*b*) has a structure without the intermediate cylinder 18. The apparatus shown in FIG. 5(*b*) has a rotating body 29. Such a simplified structure can also be adopted as long as it can apply a negative pressure to strips.

As shown in FIG. 6(*a*), the inner cylinder 17 is provided with pluralities of negative pressure conduction holes 25 and negative pressure conduction grooves 26. The right side in FIG. 6(*a*) is the one end side of the negative pressure roll 9, and when the vacuum pump is operated, a negative pressure is also generated in the negative pressure conduction holes 25 and the negative pressure conduction grooves 26 via the negative pressure conduction portion 27. The negative pressure is applied by the negative pressure conduction grooves 26 up to the end portion on the side opposite to the side on which the negative pressure conduction holes 25 are provided.

As shown in FIG. 6(*b*), the intermediate cylinder 18 is provided on the outside of the inner cylinder 17. The intermediate cylinder 18 is formed of a tubular material made of metal, synthetic resin, or hard rubber, and in the surface thereof, many ventilation holes 30 are formed. The ventilation holes 30 are positioned at fixed intervals along the longitudinal direction and the circumferential direction of the intermediate cylinder 18 so that air flows from the ventilation holes 30 into the negative pressure conduction grooves 26 to generate a negative pressure.

Around the ventilation hole 30, a ventilation hole groove portion 31 is formed toward four directions. By the ventilation hole groove portion 31, the range of the air to be suctioned into the ventilation hole 30 is enlarged.

Here, the intermediate cylinder 18 and the ventilation holes 30 do not necessarily have to be formed, and it is only required that a negative pressure can be applied to the strips. However, a negative pressure can be efficiently generated on the non-woven fabric laminated outer layer 19 by forming the intermediate cylinder 18 and providing the ventilation holes 30, so that it is preferable to form the intermediate cylinder 18 and the ventilation holes 30.

The ventilation hole groove portion 31 does not necessarily have to be provided around the ventilation hole 30. However, by enlarging the negative pressure generation region, the degree of negative pressure inside the negative pressure roll 9 can be further increased, so that it is preferable to provide the ventilation hole groove portion 31 around the ventilation hole 30. The shape of the ventilation hole groove portion is not particularly restricted, and the ventilation hole groove portion 32 may be formed toward eight directions by increasing the number of grooves as shown in FIG. 6(*c*).

FIG. 7(*a*) shows an intermediate cylinder 18 made of perforated metal 33 as another example of the intermediate cylinder 18. The perforated metal 33 is a material in which many small-diameter holes 34 are formed by punching a planar metal strip. FIG. 7(*b*) shows small-diameter holes 34 formed in the perforated metal 33. Like the ventilation holes 30, the small-diameter holes 34 flow air into the negative pressure conduction grooves 26; however, the small-diameter holes are smaller than the ventilation holes 30. As the perforated metal 33, one available on the market can also be used.

As shown in FIG. 7(*c*), the non-woven fabric laminated outer layer 19 is provided on the outside of the intermediate cylinder 18. The non-woven fabric laminated outer layer 19 is made of non-woven fabric 35 low in breathability, and its air permeability is 0.8 $cm^3/cm^2 \cdot s$ or less measured by a Frazier type air permeability tester. The non-woven fabric 35 has an appropriate frictional coefficient and elasticity, and generates a sufficient frictional force between this and strips 14, and hardly damages the strips even when it comes into contact with the strips.

Here, the non-woven fabric laminated outer layer 19 does not necessarily have to be made of non-woven fabric 35 low in breathability, and it is only required to apply a negative pressure to strips. However, it is preferable to make the non-woven fabric laminated outer layer 19 of the non-woven fabric 35 low in breathability since this makes it possible to easily adjust the air permeability of the outer layer portion.

The air permeability of the non-woven fabric laminated outer layer 19 does not necessarily have to be 0.8 $cm^3/cm^2 \cdot s$ or less measured by a Frazier type air permeability tester, and it is only required to apply a negative pressure to strips. However, it is preferable to set the air permeability of the non-woven fabric laminated outer layer 19 to 0.8 $cm^3/cm^2 \cdot s$ or less measured by a Frazier type air permeability tester since this increases the degree of negative pressure inside the negative pressure roll and makes it possible to sufficiently grip and convey the strips 14.

FIG. 8(*a*) shows details of the X portion of the negative pressure roll shown in FIG. 2. The negative pressure conduction grooves 26 are formed on the surface of the inner cylinder 17, and ventilation holes 30 of the intermediate cylinder 18 are positioned at fixed intervals. Further, on the outside of the ventilation holes 30, the non-woven fabric laminated outer layer 19 is formed, and strips 14 come into contact with the non-woven fabric. FIG. 8(*b*) is a cross sectional view in the C-C direction of the cross sectional view of FIG. 8(*a*). The view of FIG. 8(*b*) is in an arc shape in actuality; however, for convenience of description, it is shown as a linear view.

FIG. 9(*a*) shows details of the X portion of the negative pressure roll in the case where the intermediate cylinder 18 is formed of perforated metal 33. On the surface of the inner cylinder 17, the negative pressure conduction grooves 26 are formed, and on the outside thereof, the perforated metal 33 is positioned. On the outside of the perforated metal 33, the non-woven fabric laminated outer layer 19 is formed, and strips 14 come into contact with the non-woven fabric. FIG. 9(*b*) is a cross sectional view in the C-C direction of the cross sectional view of FIG. 9(*a*). The view of FIG. 9(*b*) is in an arc shape in actuality; however, for convenience of description, it is shown as a linear view.

The non-woven fabric used in the negative pressure roll is described.

Figure 10:
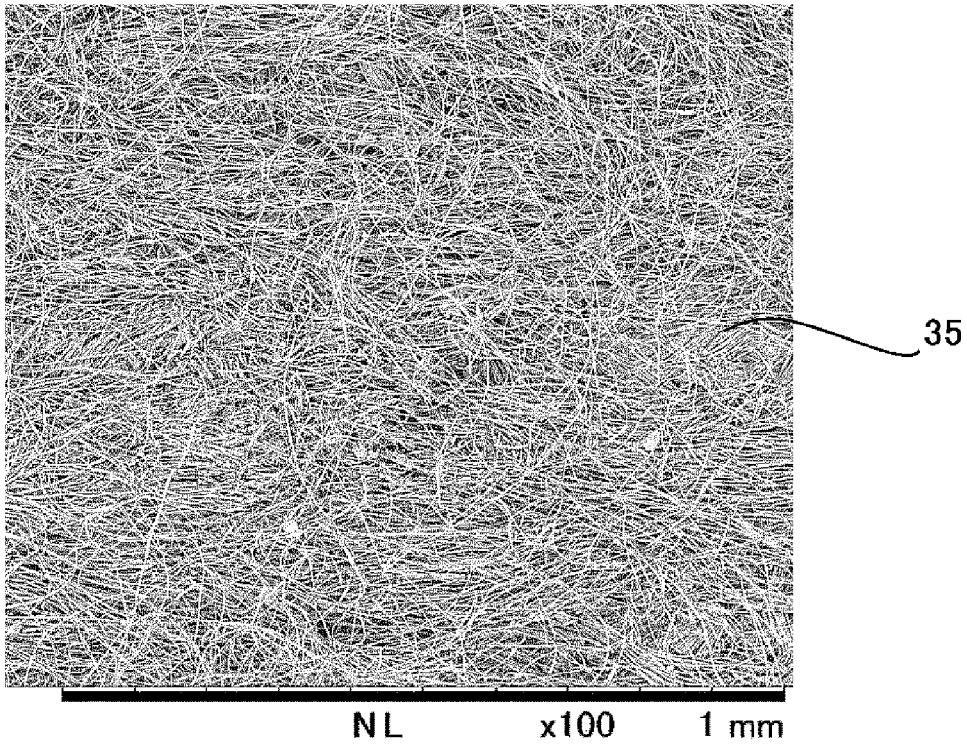
FIG. 10 is a view showing an enlarged microphotograph of non-woven fabric used in the negative pressure roll.
Figure 11:
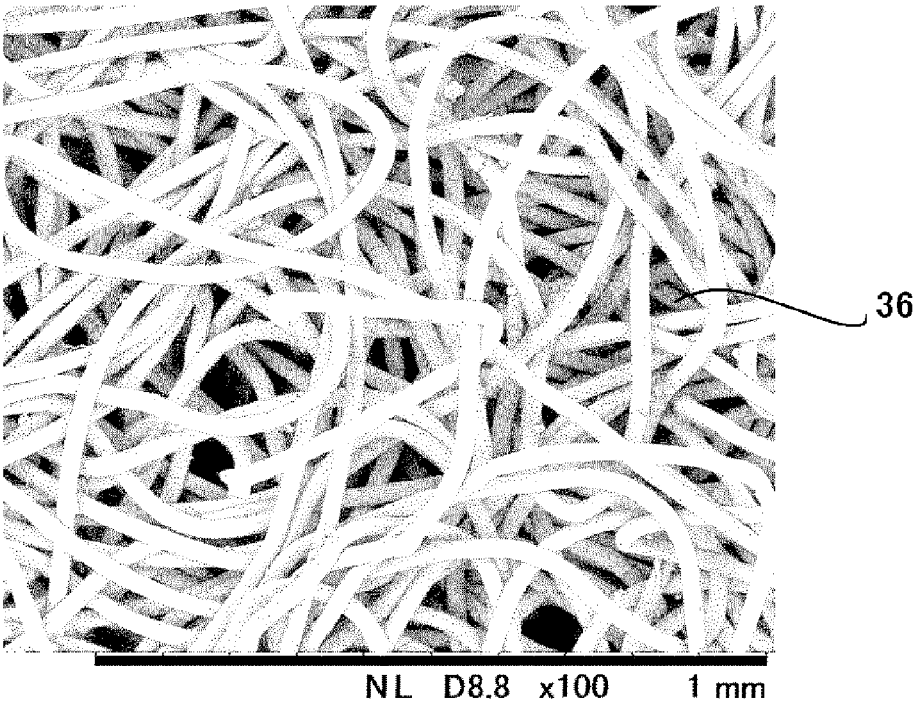
FIG. 11 is a view showing an enlarged microphotograph of generally used non-woven fabric.
Figure 12:
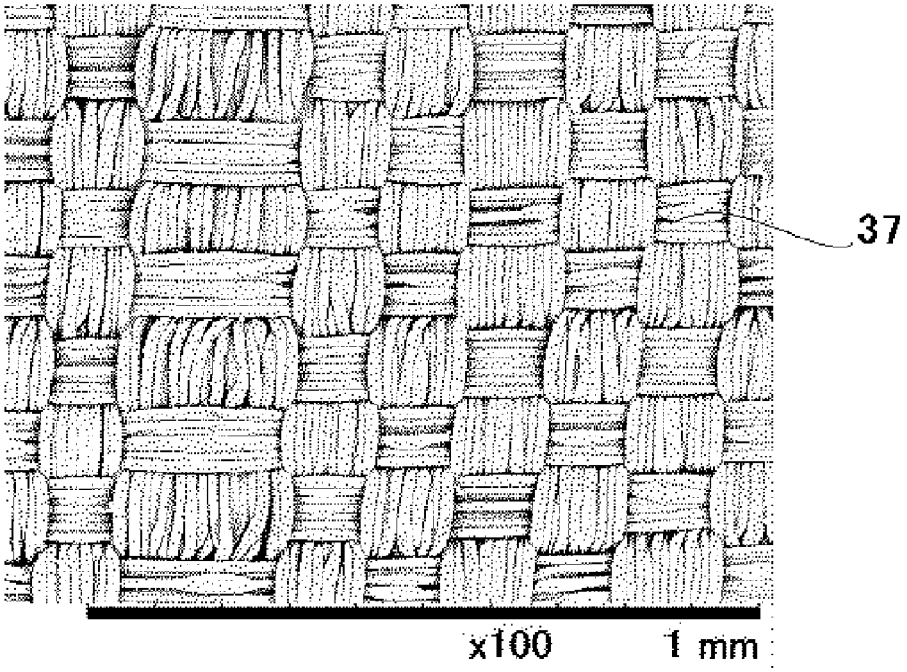
FIG. 12 is a view showing an enlarged microphotograph of high-density woven fabric.
Figure 13:
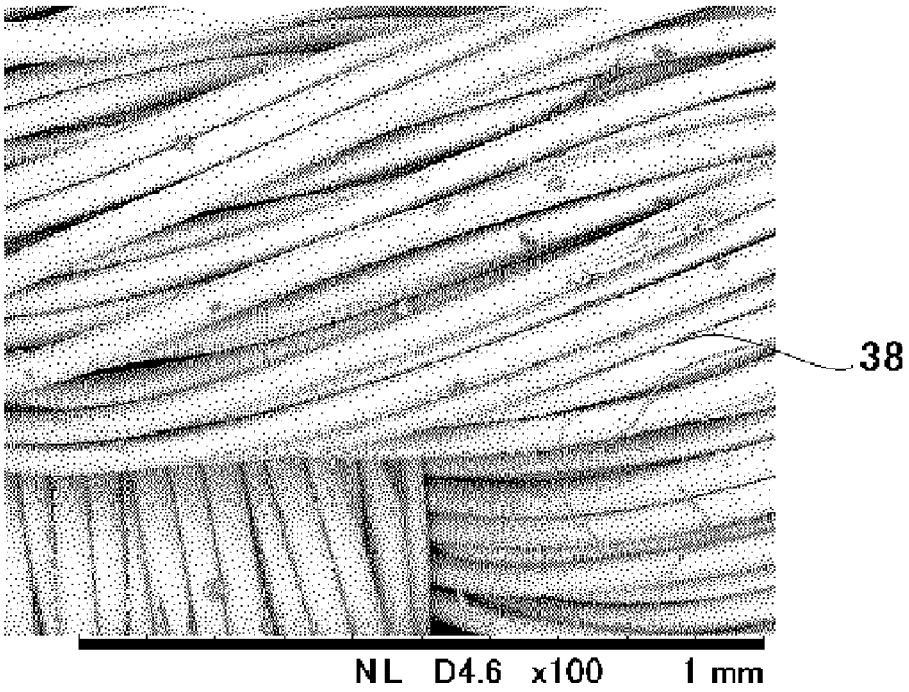
FIG. 13 is a view showing an enlarged microphotograph of generally used woven fabric.

FIG. 10 is a view showing an enlarged microphotograph of the non-woven fabric used in the negative pressure roll. FIG. 11 is a view showing an enlarged microphotograph of generally used non-woven fabric. FIG. 12 is a view showing an enlarged microphotograph of high-density woven fabric. FIG. 13 is a view showing an enlarged microphotograph of generally used woven fabric.

FIG. 10 shows a microphotograph (a magnification of 100 times) of the non-woven fabric 35 used in the negative pressure roll 9. The non-woven fabric 35 is formed by entwining fibers with a fiber diameter of approximately 4 μm at a high density. One sheet of non-woven fabric 35 can realize a low air permeability of approximately 0.8 $cm^3/cm^2 \cdot s$ or less measured by a Frazier type air permeability tester. Between the extra fine fibers of the non-woven fabric 35, many spaces with sizes of micrometers are present, and through these spaces, the negative pressure easily reach the entire surface of the non-woven fabric laminated outer layer 19.

On the other hand, FIG. 11 shows a microphotograph of the non-woven fabric 36 generally used for a tension pad that is one of tensioners. The non-woven fabric 36 is formed by entwining fibers with a fiber diameter of approximately 20 to 30 μm, and is lower in density than the non-woven fabric 35. One sheet of non-woven fabric 36 has a Frazier type air permeability of 50 to 100 $cm^3/cm^2 \cdot s$, and it is difficult to use this as the non-woven fabric of the non-woven fabric laminated outer layer 19.

Here, by combining the non-woven fabric 36 with a material low in air permeability of approximately 0.8 $cm^3/cm^2 \cdot s$ or less measured by a Frazier type air permeability tester, for example, high-density woven fabric 37 such as nylon woven fabric, low breathability can also be realized. That is, it is also possible that by sandwiching a high-density woven fabric 37 between non-woven fabrics 36, the non-woven fabric laminated outer layer 19 can be formed. FIG. 12 shows the high-density woven fabric 37 and FIG. 13 shows the generally used woven fabric 38 as enlarged microphotographs (a magnification of 100 times).

The non-woven fabric laminated outer layer 19 does not necessarily have to be formed of one non-woven fabric 35. For example, a structure that realizes low air permeability by overlapping a plurality of non-woven fabrics can also be adopted.

As the outer layer portion of the negative pressure roll 9, a structure in which a non-woven fabric low in breathability and artificial leather which is laminated on the outside of the non-woven fabric and with many minute through-holes are combined to form the outer layer portion can also be adopted. As artificial leather, by using a material with a frictional coefficient higher than that of the non-woven fabric, the gripping force for gripping strips can be increased. Here, instead of artificial leather, a material with a frictional coefficient higher than that of the non-woven fabric can be used, and for example, a rubber material can also be used.

A structure relating to moving up and down of the negative pressure roll is described.

Figure 14:
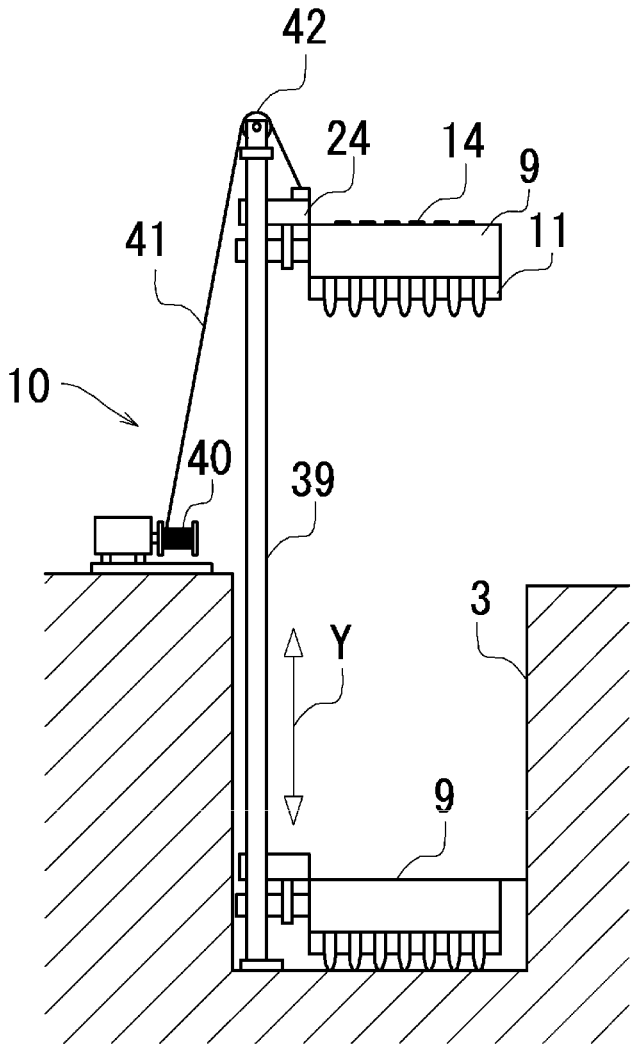
FIG. 14 is a schematic view of a negative pressure roll and an up-down moving device from the side.

FIG. 14 is a schematic view of the negative pressure roll and the up-down moving device from the side.

As described above, the negative pressure roll 9 can be moved up and down in the vertical direction by the up-down moving device 10. As shown in FIG. 14, the up-down moving device includes an up-down guide member 24 joined to the above-described negative pressure roll 9, a guide post 39 which is provided in the loop pit 3 and to which the guide member 24 is attached, and a motor-driven winch 40.

To the up-down guide member 24, a rope 41 is anchored, and via a guide roll 42 disposed on the tip end of the guide post 39, the rope 41 is wound by the motor-driven winch 40. The arrow Y in the drawing shows the up-down moving direction of the negative pressure roll 9, and the negative pressure roll 9 is movable up and down in the range from the bottom surface of the loop pit 3 to the upper end of the guide post 39.

The guide post 39 and the guide member 24 are joined by a known linear guide rail structure, and can move the negative pressure roll 9 up and down while keeping it in a horizontal direction.

Here, the constitution of the up-down moving device 10 does not necessarily have to be adopted to move the negative pressure roll 9 up and down, and it is only required to stably move the negative pressure roll 9 up and down in the vertical direction. For example, as a drive source, an electrically-operated treaded rod rotating structure and a telescoping structure using a hydraulic cylinder, etc., can also be adopted as well as the motor-driven winch.

Operation steps of the absorption apparatus 1 constituted as described above are described.

Figure 15:
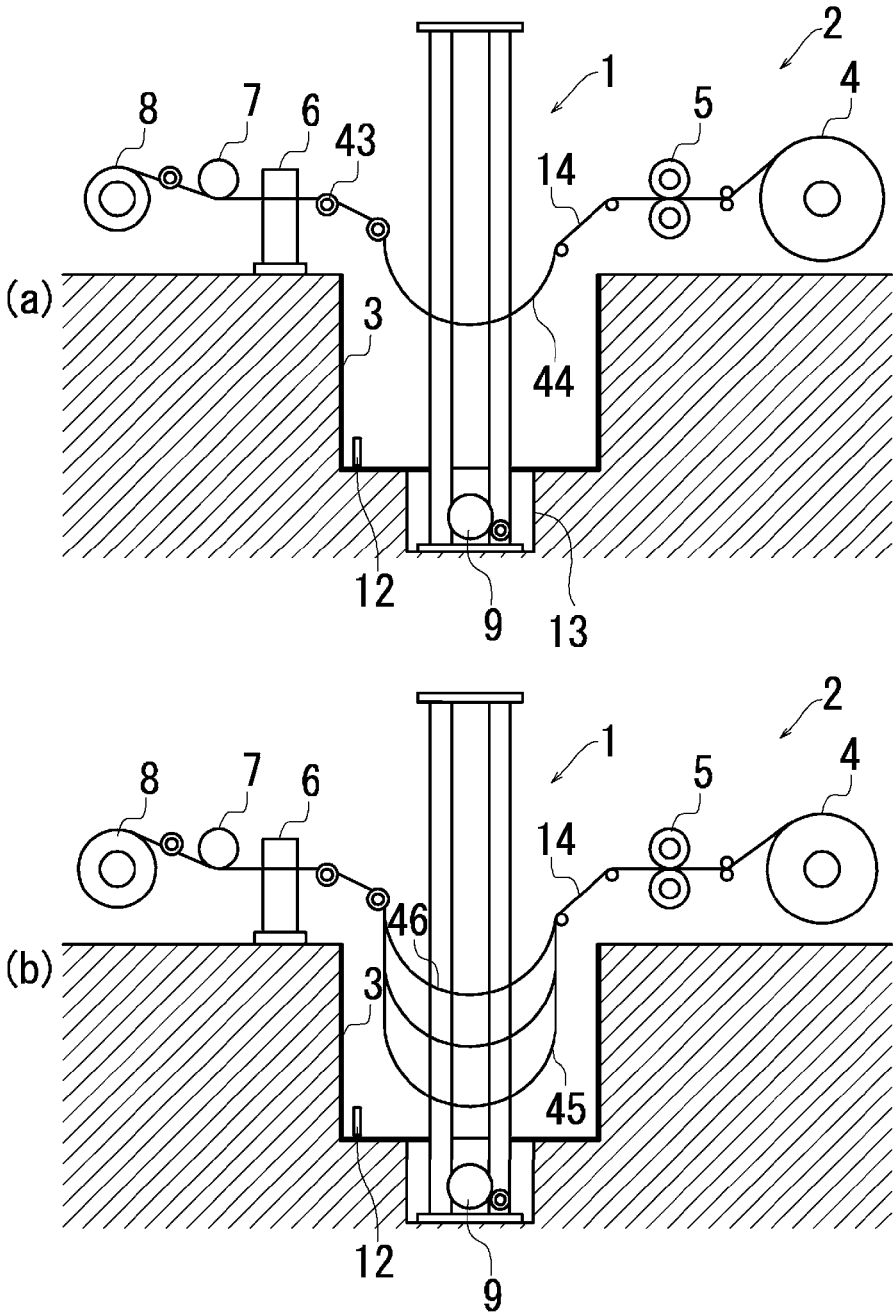
FIG. 15(*a*) is a schematic view when starting operation of the slitter line and FIG. 15(*b*) is a schematic view when the loop hang-down amounts of strips change.
Figure 16:
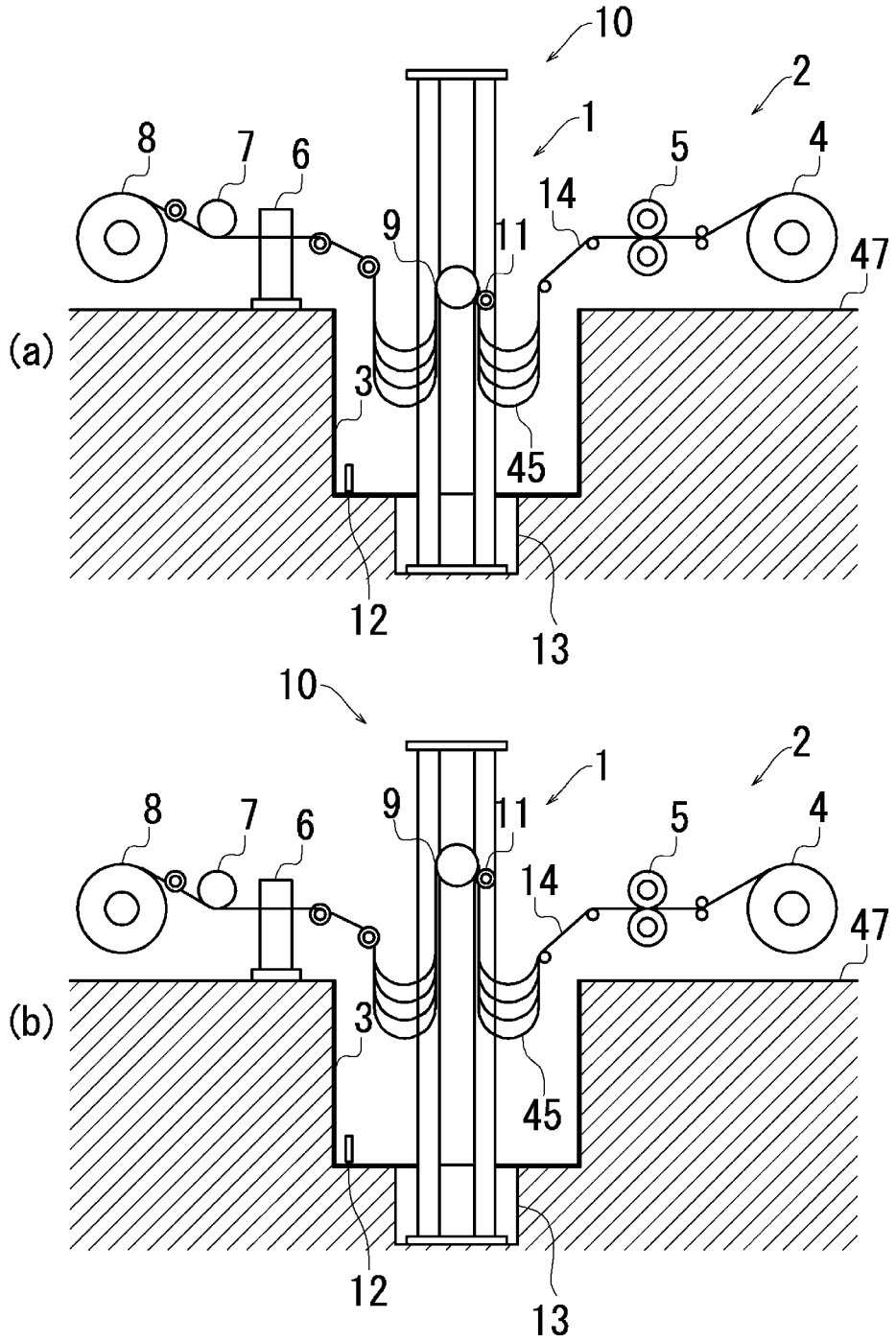
FIG. 16(*a*) is a schematic view showing a state in which strips are set on the negative pressure roll, and FIG. 16(*b*) is a schematic view showing a state in which the negative pressure roll moves up.
Figure 17:
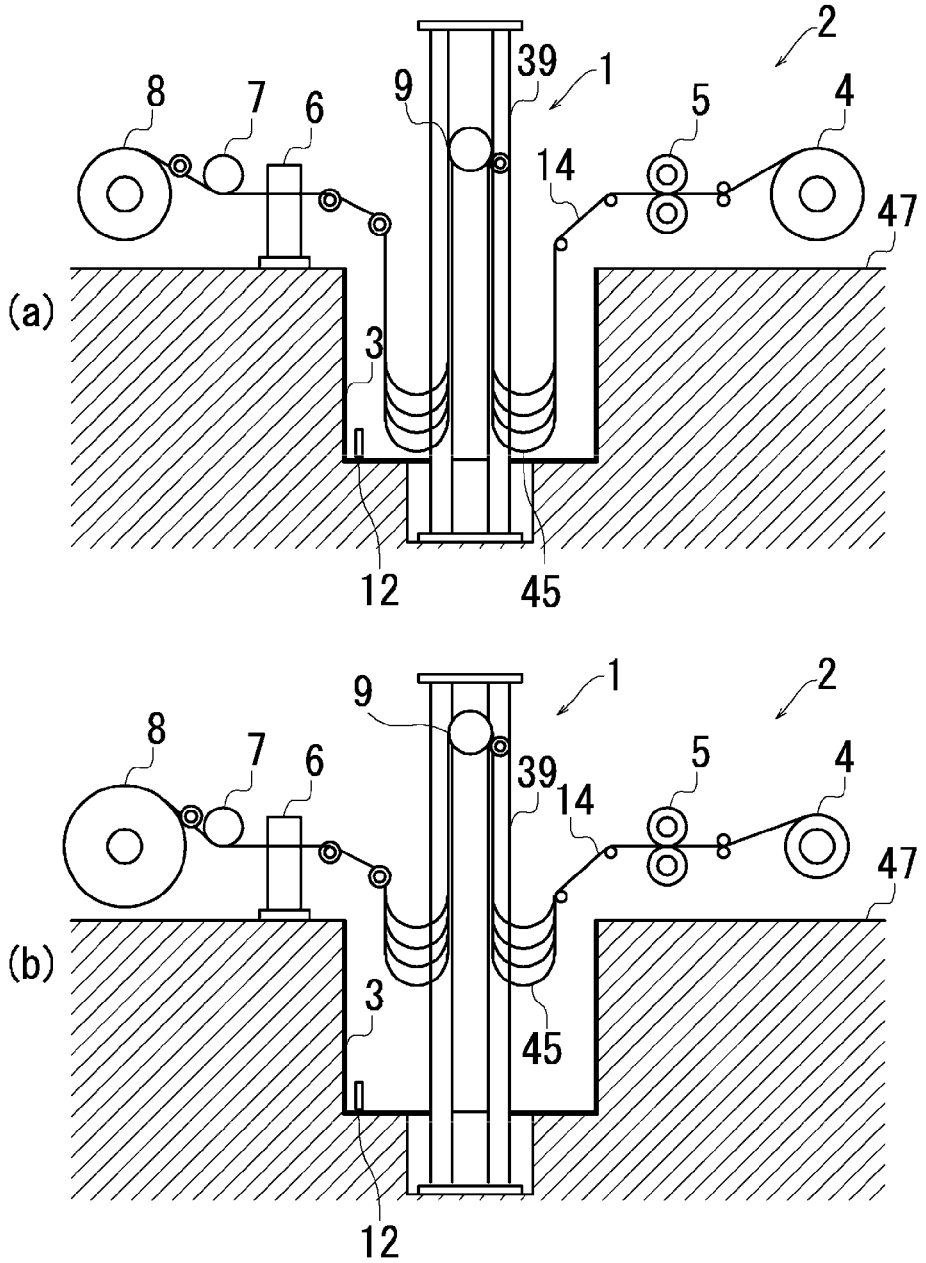
FIG. 17(*a*) is a schematic view showing a state in which the negative pressure roll is at a moved-up position and the loop hang-down amounts increase, and FIG. 17(*b*) is a schematic view showing a state in which the negative pressure roll moves up to the upper limit of the up-down guide post.

FIG. 15(*a*) is a schematic view when starting operation of the slitter line, and FIG. 15(*b*) is a schematic view when the loop hang-down amounts of strips change. FIG. 16(*a*) is a schematic view showing a state in which strips are set on the negative pressure roll, and FIG. 16(*b*) is a schematic view showing a state in which the negative pressure roll moves up. FIG. 17(*a*) is a schematic view showing a state in which the negative pressure roll is at a moved-up position and the loop hang-down amounts increase, and FIG. 17(*b*) is a schematic view showing a state in which the negative pressure roll moves up to the upper limit of the up-down guide post.

As shown in FIG. 15(*a*), when starting operation of the slitter line 2, in order to prevent a situation in which the tension to be applied to the strips 14 by the winding machine 8 acts on the blade of the slitter 5 and uniform cut surfaces cannot be obtained, the slit strips are hung down inside the loop pit 3 and form small loops 44.

Immediately after slitting, spaces are hardly present between the strips 14. However, when the strips are subjected to the tensioner 6, spaces are formed between the strips 14 by the partition disks of the separator 43 before the tensioner 6. The small loops 44 formed by the strips 14 above the loop pit perform the function of buffering the presence and absence of the spaces between the strips 14.

In the slitter line 2, the speeds of the uncoiler 4, the slitter 5, and the winding machine 8 are synchronized and threading of the strips 14 is started. At this time, the negative pressure roll 9 is stored at the negative pressure roll standby position 13 on the bottom surface of the loop pit 3. The negative pressure roll 9 does not necessarily have to be positioned at the negative pressure roll standby position 13.

When threading of the strips 14 progresses, due to the differences in thickness among the strips 14, the coil diameters of the strips 14 differ from each other on the winding machine 8, and the winding speed gradually starts to differ among the strips 14. As shown in FIG. 15(*b*), above the loop pit 3, the hang-down amount of the loop 45 of the thick strip 14 whose wound coil diameter is small becomes larger, and becomes different from the hang-down amount of the loop 46 of the strip 14 whose wound coil diameter is large.

Before the loop 45 of the strip 14 whose wound coil diameter is small comes into contact with the floor surface of the loop pit 3, the up-down moving device 10 is operated to move up the negative pressure roll 9 to the vicinity of the floor surface 47 as shown in FIG. 16(*a*).

In addition, the slitter line 2 is temporarily stopped and the strips 14 are set on the negative pressure roll 9 and the separator 11. Thus, by moving up the negative pressure roll 9 to the vicinity of the floor surface 47, the operation of setting the strips 14 can be easily performed. Detection before the loop 45 of the strip 14 whose wound coil diameter is small comes into contact with the floor surface of the loop pit 3 can be performed with the sensor 12. This operation can also be performed by visual confirmation.

First, by setting strips 14 on the negative pressure roll 9, in a line stopped state, two loops each of the strips 14 are formed inside the loop pit 3. Subsequently, the slitter line 2 and the vacuum pump and the drive motor 21 of the negative pressure roll 9 are operated to make the pressure inside the negative pressure roll 9 negative and make the negative pressure roll 9 start rotating movement in a direction in which the strips 14 are threaded. The strips 14 set on the negative pressure roll 9 are gripped by the surface of the negative pressure roll 9, and fed out in the advancing direction.

By synchronizing the rotation speed of the negative pressure roll 9 with the speeds of the slitter 5 and the winding machine 8, the state in which the strips 14 to be gripped and conveyed form two loops is maintained. That is, it becomes possible to allow a large difference between a large loop and a small loop of the strips. The rotation speed of the negative pressure roll 9 is electrically programmed so as to synchronize with the line speed.

When strips 14 are set on the negative pressure roll 9 and the line is operated, in the state in which two loops are formed, the hang-down amount of the strip 14 whose wound coil diameter is small among the strips increases. Here, as shown in FIG. 16(*b*), the negative pressure roll 9 can be moved up by the up-down moving device 10 while being operated. By moving up the negative pressure roll 9, it becomes possible to increase the hang-down amounts of the two loops. That is, it becomes possible to allow a larger difference between a large loop and a small loop of the strips.

As threading of the strips further progresses, even when the negative pressure roll 9 is positioned at the height shown in FIG. 17(*a*), the hang-down amount of the loop 45 of the strip 14 whose wound coil diameter is small increases and the loop approaches the floor surface of the loop pit 3.

In this case, as shown in FIG. 17(*b*), by moving up the negative pressure roll 9 to the upper limit of the up-down guide post 39 by the up-down moving device 10, the hang-down amounts of the two loops can be further increased. That is, it becomes possible to allow a still larger difference between a large loop and a small loop of the strips. It is also possible that, in this case, the negative pressure roll 9 is automatically moved up in response to a signal from the sensor 12.

Thus, due to the negative pressure roll 9, two loops of the strips 14 can be formed before and after the negative pressure roll 9, so that as compared with a conventional slitter line having only the loop pit, the loop amounts can be sufficiently absorbed. In addition, by changing the height of the negative pressure roll 9, the loop amounts that can be absorbed can be increased.

As a result, when the up-down moving device is installed in an existing loop pit, the loop amount absorption efficiency can be improved. When a new loop pit is provided, it becomes unnecessary to form the loop pit deep, and this leads to a reduction in cost of the facility in which the slitter line is installed and improvement in safety.

The negative pressure roll 9 grips strips 14 by a negative pressure, so that the surfaces of the strips 14 are hardly damaged. The non-woven fabric laminated outer layer 19 of the negative pressure roll 9 is made of non-woven fabric low in air permeability, so that the surfaces of the strips 14 are even less likely to be damaged.

As another example of the embodiment of the present invention, a structure in which the up-down moving device is provided near the loop pit can also be adopted.

Figure 18:
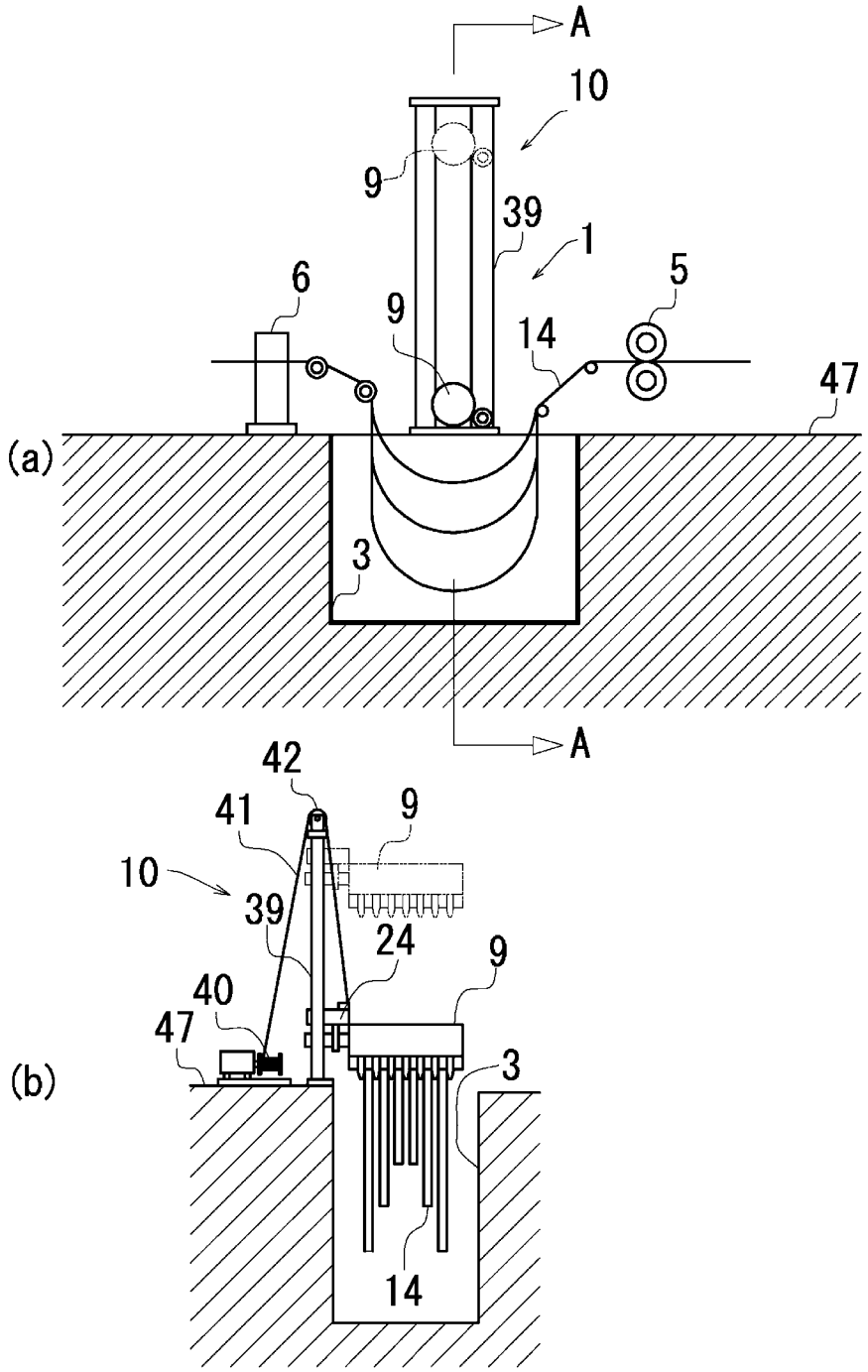
FIG. 18(*a*) is a schematic view of the apparatus in which an up-down moving device is provided near a loop pit, and FIG. 18(*b*) is a side view in the direction A-A in FIG. 18(*a*).
Figure 19:
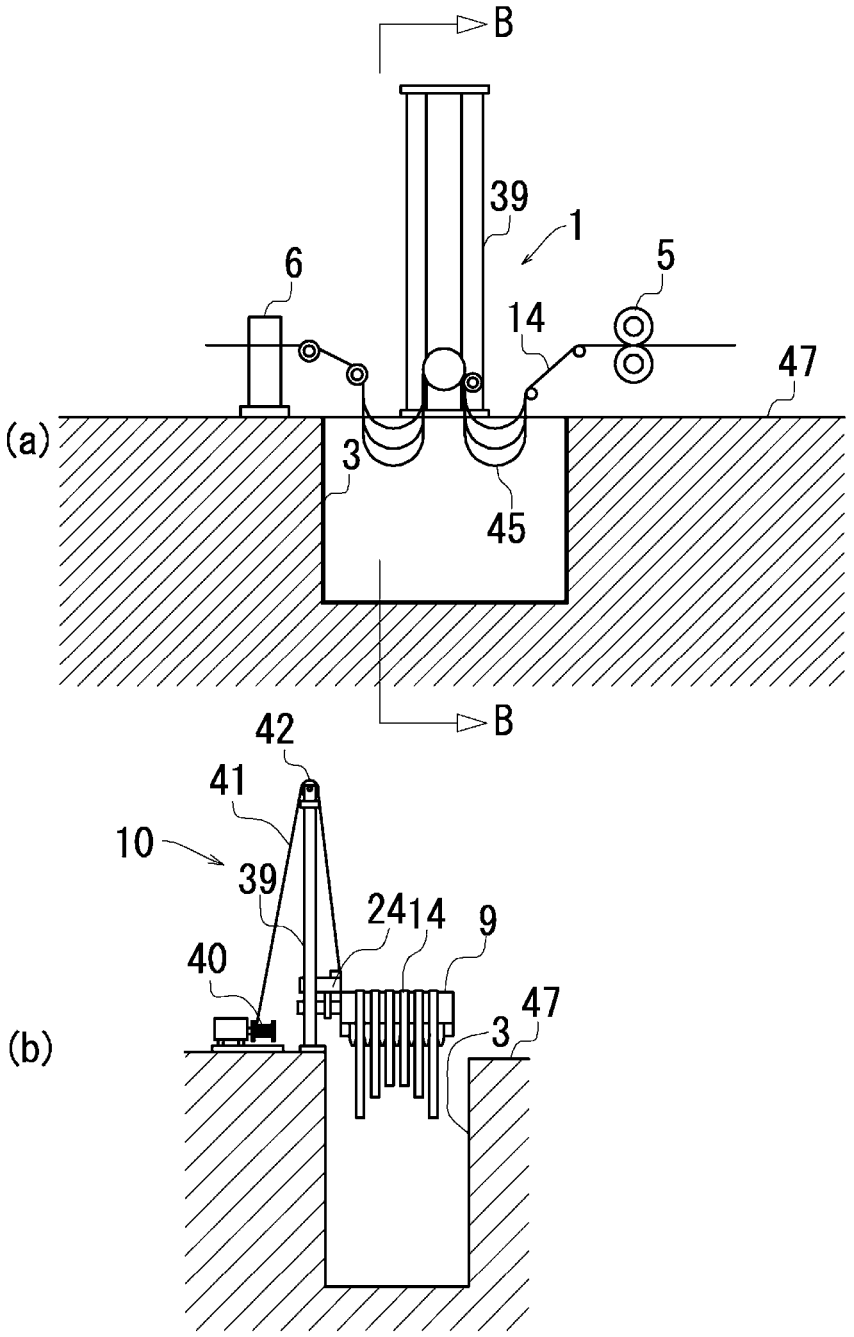
FIG. 19(*a*) is a schematic view showing a state in which strips are set on the apparatus in which an up-down moving device is provided near a loop pit, and FIG. 19(*b*) is a side view in the direction B-B in FIG. 19(*a*).

FIG. 18(*a*) is a schematic view of the apparatus in which an up-down moving device is provided near a loop pit, and FIG. 18(*b*) is a side view in the direction A-A in FIG. 18(*a*). FIG. 19(*a*) is a schematic view showing a state in which strips are set on the apparatus in which an up-down moving device is provided near a loop pit, and FIG. 19(*b*) is a side view in the direction B-B in FIG. 19(*a*).

As shown in FIG. 18(*a*), in the present embodiment, the up-down moving device 10 is provided not inside the loop pit 3 but on the floor surface 47 on which the slitter 5 and the tensioner 6 are disposed. The negative pressure roll 9 is movable up and down near the loop pit 3.

In the present embodiment, until the loop hang-down amounts of the strips 14 change from the start of the operation of the line, the negative pressure roll 9 stands by at the upper portion of the up-down moving device 10. Thereafter, when the loop of the strip whose wound coil diameter is small comes to a position at which it almost comes into contact with the floor surface of the loop pit 3, the line is stopped, and the negative pressure roll 9 is moved down to the position of the floor surface 47. FIG. 18(*b*) shows this state from the direction of the arrow A-A in FIG. 18(*a*).

A view of the state in which the strips 14 are set on the negative pressure roll 9 when the line is stopped from the direction of the arrow B-B in FIG. 19(*a*) is as shown in FIG. 19(*b*). Thereafter, the negative pressure roll 9 and the line are operated, and while the strips 14 are gripped and conveyed, the negative pressure roll 9 is moved up by the up-down moving device 10, and accordingly, it becomes possible to increase the hang-down amounts of the two loops. That is, it becomes possible to allow a still larger difference between a large loop and a small loop of the strips.

In the present embodiment, the space and labor for installing the up-down moving device 10, specifically, the up-down guide post 39 can be reduced. In addition, it becomes possible to check the up-down moving device on the floor surface 47, and the operation efficiency of maintenance, etc., can be improved. These lead to a reduction in cost of facility installation.

As another example of the embodiment of the present invention, a structure in which two absorption apparatuses are provided on the slitter line can also be adopted.

Figure 20:
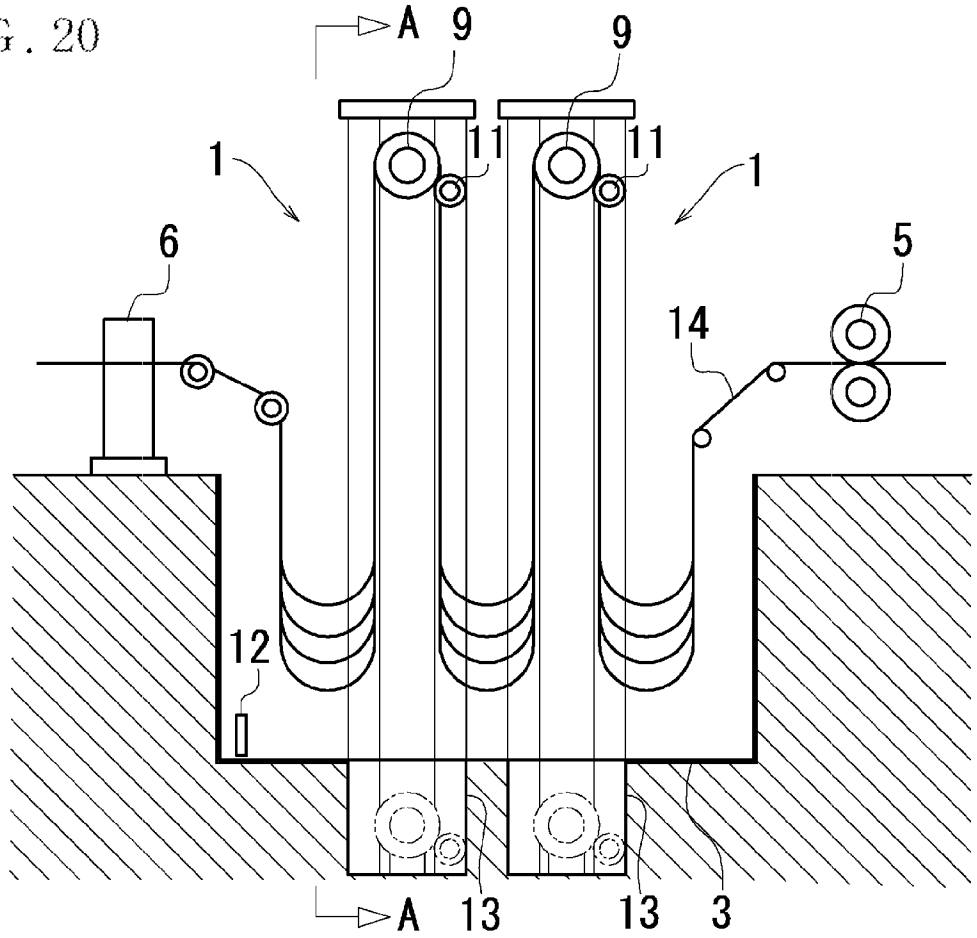
FIG. 20 is a schematic view of the slitter line in a case where two absorption apparatuses are provided.

FIG. 20 is a schematic view of the slitter line in the case where two absorption apparatuses are provided.

In the case where wound coils of strips are manufactured from a longer metal strip, or in the case where it is desired to further increase the loop amount absorption efficiency, as shown in FIG. 20, it is also possible to provide two structures of absorption apparatuses 1 in the loop pit 3.

Figure 21:
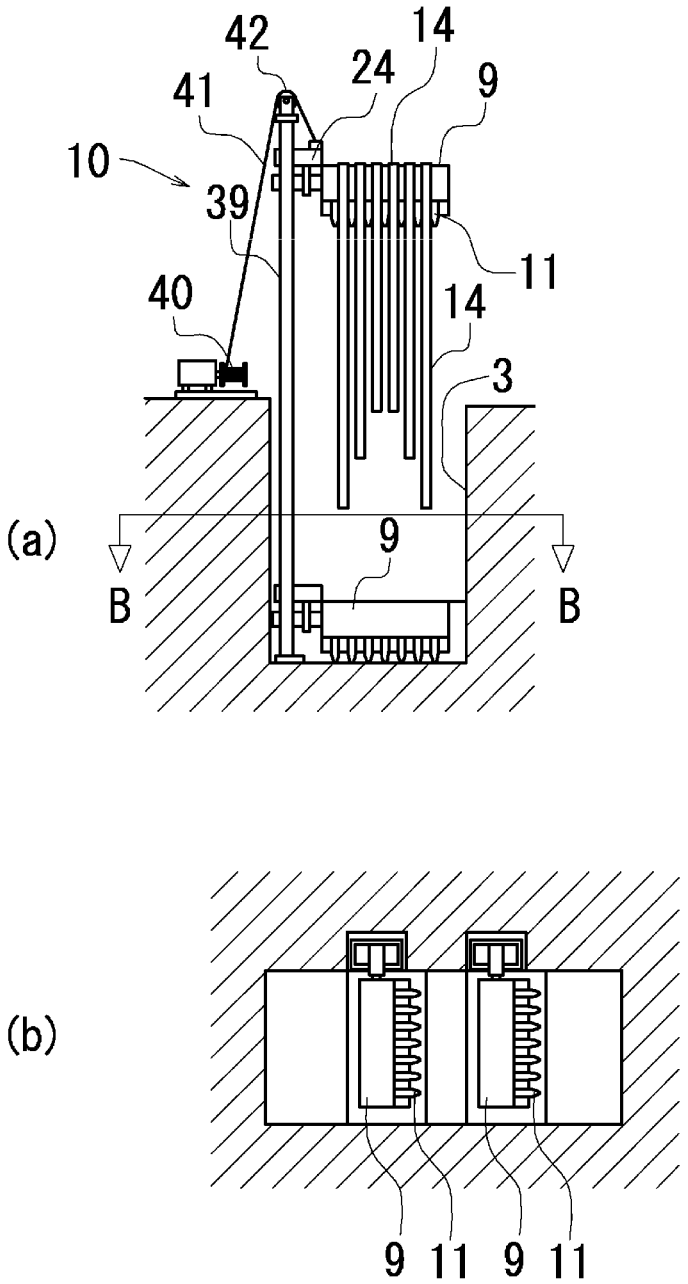
FIG. 21(*a*) is a side view in the direction A-A in FIG. 20, and FIG. 21(*b*) is a plan view in the arrow B direction in FIG. 21(*a*).
Figure 22:
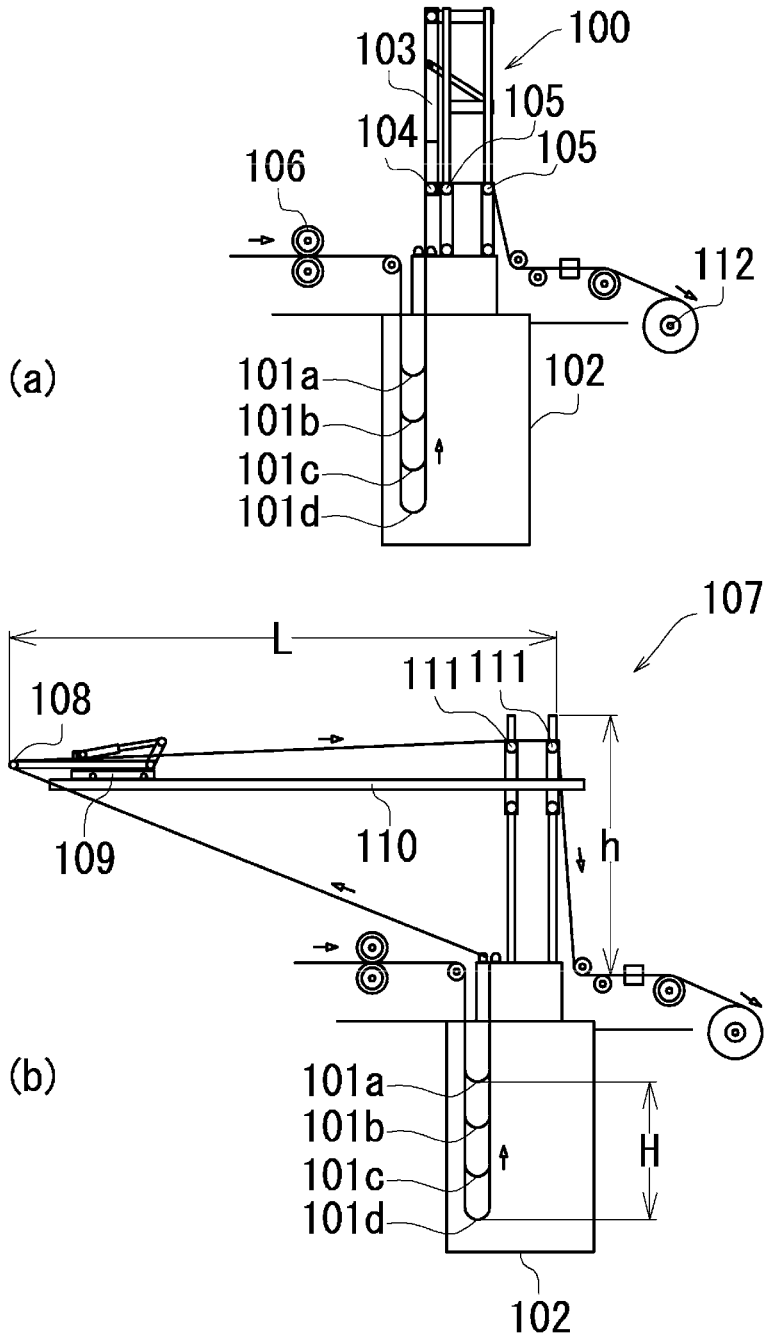
FIG. 22(*a*) is a schematic view showing an example of a conventional loop absorption apparatus, and FIG. 22(*b*) is a schematic view showing another example.
Figure 23:
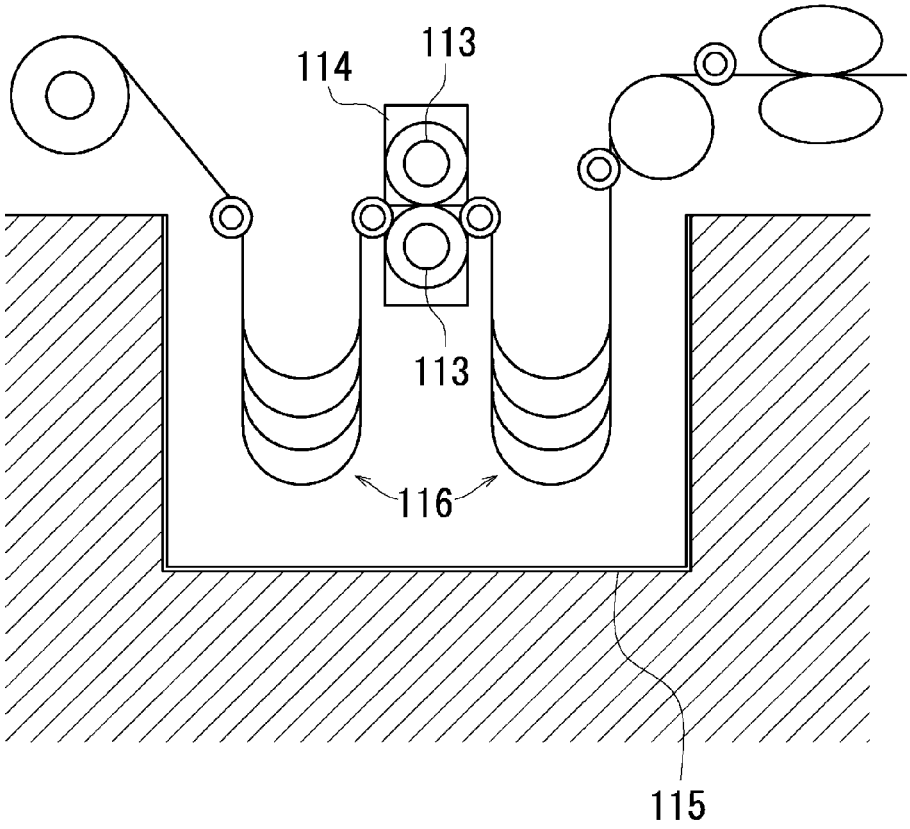
FIG. 23 is a schematic view showing an absorption apparatus using a conventional pinch roll type conveyance roll.

As shown in FIG. 20, by disposing two absorption apparatuses 1, three loops of the strips 14 can be formed inside the loop pit 3, and the loop amount absorption efficiency can be further increased. FIG. 21(*a*) is a side view in the arrow A-A direction in FIG. 20, and FIG. 21(*b*) is a plan view in the arrow B direction in FIG. 21(*a*).

Here, the embodiment of the present invention is not limited to the structure in which two absorption apparatuses 1 are provided, and a structure in which three or more absorption apparatuses are provided and a structure in which two absorption apparatuses are provided at a distance are also possible as necessary.

As described above, the loop amount absorption apparatus of a slitter line according to the present invention hardly damages the metal strips, and can absorb sufficiently long loops formed on the line.

DESCRIPTION OF REFERENCE NUMERALS

1 Absorption apparatus
2 Slitter line
3 Loop pit
4 Uncoiler
5 Slitter
6 Tensioner
7 Deflector roll
8 Winding machine
9 Negative pressure roll
10 Up-down moving device
11 Separator
12 Sensor
13 Negative pressure roll standby position
14 Strips
15 Loop
16 Rotating shaft
17 Inner cylinder
18 Intermediate cylinder
19 Non-woven fabric laminated outer layer
20 Reinforcement disk
21 Drive motor
22 Chain
23 Bearing
24 Up-down guide member
25 Negative pressure conduction hole
26 Negative pressure conduction groove
27 Negative pressure conduction portion
28 Partition projection
29 Rotating body
30 Ventilation hole
31 Ventilation hole groove portion (in four directions)
32 Ventilation hole groove portion (in eight directions)
33 Perforated metal
34 Small-diameter hole
35 Non-woven fabric low in breathability
36 Generally used non-woven fabric
37 High-density woven fabric
38 Generally used woven fabric
39 Guide post
40 Motor-driven winch
41 Rope
42 Guide roll
43 Separator
44 Loop
45 Loop (small coil diameter)
46 Loop (large coil diameter)
47 Floor surface

What is claimed is:

1. A loop amount absorption apparatus disposed between a slitter and a tensioner of a slitter line, the loop amount absorption apparatus comprising:

a rotating body that is constituted to be rotatable and movable up and down along one or more substantially vertical guide members;

a conduction hole which is provided inside the rotating body and in which a negative pressure is formed by a predetermined suction device;

a conduction groove formed on the surface of the rotating body and connected to the conduction hole; and an outer layer portion low in air permeability provided on the outside of the conduction groove, wherein the outer layer portion comprises a non-woven fabric.

2. The loop amount absorption apparatus according to claim 1, wherein the air permeability of the outer layer portion is 0.8 cm3/cm2·s or less measured by a Frazier type air permeability tester.

3. The loop amount absorption apparatus according to claim 1, wherein the rotating body is constituted to be movable up from a vicinity of a loop pit that is a recess formed in a region between the slitter and the tensioner.

4. The loop amount absorption apparatus according to claim 3, wherein the rotating body is constituted to be movable up from a vicinity of a bottom portion of the loop pit that is a recess formed in the region between the slitter and the tensioner.

5. The loop amount absorption apparatus according to claim 4, comprising:

a sensor unit that is disposed at the bottom portion of the loop pit for detecting strips.

6. The loop amount absorption apparatus according to claim 1, wherein the rotating body is constituted so that a rotation speed thereof is adjustable.

7. The loop amount absorption apparatus according to claim 1, further comprising:

a separator that is disposed on a side of the rotating body proximate the slitter and has a plurality of partition disks substantially parallel to an advancing direction of strips to be threaded.

8. The loop amount absorption apparatus according to claim 1, comprising:

a substantially cylindrical intermediate cylinder portion that is provided between the conduction groove and the outer layer portion and has a plurality of ventilation holes formed therein.

9. The loop amount absorption apparatus according to claim 1, wherein the rotating body is formed into a substantially cylindrical shape, a plurality of the conduction holes are formed in a circumferential direction of the rotating body, and the conduction holes adjacent to each other are at a fixed interval, and a plurality of the conduction grooves are formed in a longitudinal direction of the rotating body, and the conduction grooves adjacent to each other are at a fixed interval.

10. The loop amount absorption apparatus according to claim 1, wherein the non-woven fabric is disposed on an outside of the conduction groove, and wherein the outer layer portion further comprises an outer layer member that is laminated on an outside of the non-woven fabric, has a frictional coefficient higher than that of the non-woven fabric, and has a plurality of through-holes formed therein.

* * * * *